US005156013A

United States Patent [19]

Arima et al.

[11] Patent Number: 5,156,013

[45] Date of Patent: Oct. 20, 1992

[54] CONTROL DEVICE FOR ABSORPTION REFRIGERATOR

[75] Inventors: Hidetoshi Arima, Gunma; Eiichi Enomoto, Saitama; Masahiro Furukawa, Gunma; Kazuhiro Yoshii, Gunma; Masayuki Oonou, Gunma; Toshiyuki Kaneko, Ota; Atsushi Ogawa, Hirakata; Masahiro Maekawa, Hirakata; Kazuhiro Hitomi, Hirakata, all of Japan

[73] Assignee: Sanyo Electric Co., Ltd., Osaka, Japan

[21] Appl. No.: 706,606

[22] Filed: May 28, 1991

[30] Foreign Application Priority Data

| | | | |
|---|---|---|---|
| May 29, 1990 | [JP] | Japan | 2-141151 |
| May 31, 1990 | [JP] | Japan | 2-142323 |
| Jun. 13, 1990 | [JP] | Japan | 2-156311 |
| Jul. 6, 1990 | [JP] | Japan | 2-180079 |

[51] Int. Cl.[5] ..... F25B 15/00; G05D 15/00

[52] U.S. Cl. ..... 62/148; 236/78 D; 395/61

[58] Field of Search ..... 62/148; 236/78 D; 395/900, 61

[56] References Cited

PUBLICATIONS

Applications of Fuzzy Set Theory, *Maiers et al.* IEEE 1985, pp. 175–189.

Control Engineering, McCusker, May 1990, Neural Networks and Fuzzy Logic Tool of Promise for Controls.

A VLSI Fuzz Logic Controller, Watanabe et al., Apr. 1990 IEEE.

*Primary Examiner*—William E. Wayner

*Attorney, Agent, or Firm*—Armstrong, Nikaido, Marmelstein, Kubovcik & Murray

[57] ABSTRACT

A control device for an absorption refrigerator which forms a refrigeration cycle by connecting an evaporator, an absorption unit, a generator, a condenser and the like to control a heating amount of the generator. Singular or plural amounts of change representative of externasl conditions are detected. A heating amount of the generator is controlled by a fuzzy logic calculation.

15 Claims, 21 Drawing Sheets

FIG. 2
| eTo | NB | NS | ZR | PS | PB |
|---|---|---|---|---|---|
| KQ | NB | NS | ZR | PS | PB |
FIG. 3
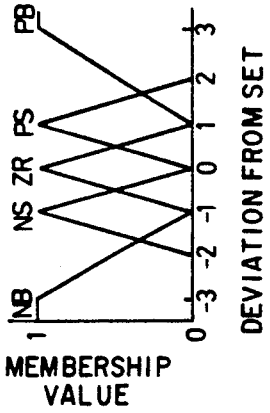
FIG. 4
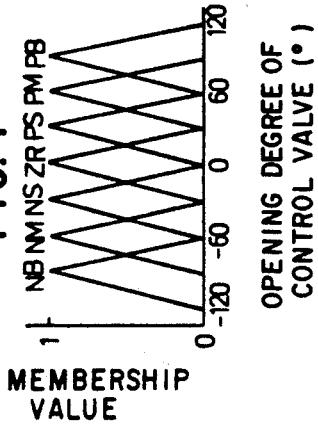
FIG. 5
| eTo | NB | NS | ZR | PS | PB |
|---|---|---|---|---|---|
| KQ | NB | NS | ZR | PS | PB |
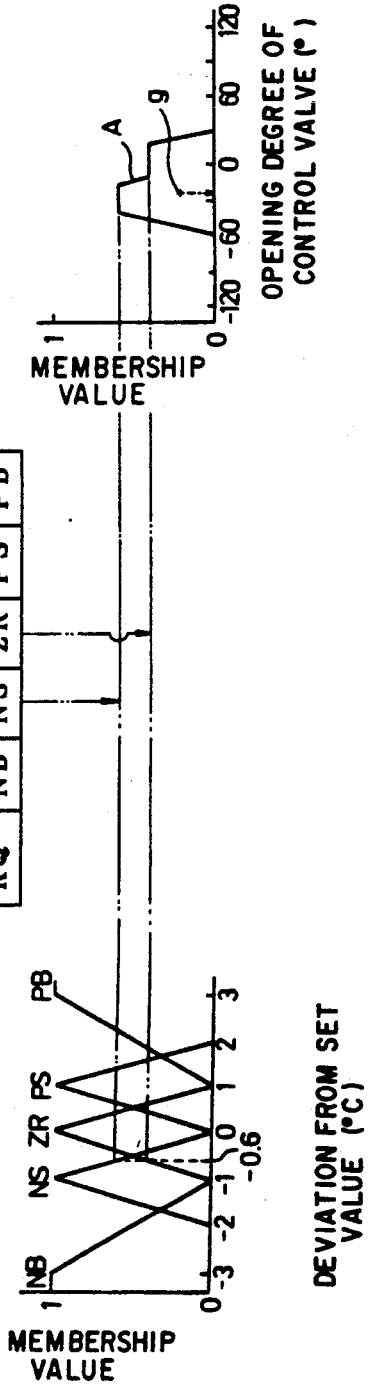

| eTo | PB | PS | ZR | NS | NB |
|---|---|---|---|---|---|
| KQ | PM | PS | ZR | NM | NB |

| eTo | PB | PS | ZR | NS | NB |
|---|---|---|---|---|---|
| KQ | PM | PS | ZR | NM | NB |

| eTo | PB | PS | ZR | NS | NB |
|---|---|---|---|---|---|
| KQ | PB | PS | ZR | NS | NB |

FIG. 12
| dTd | NB | NS | ZR | PS | PB |
|---|---|---|---|---|---|
| KQ | NB | NS | ZR | PS | PB |
FIG. 13
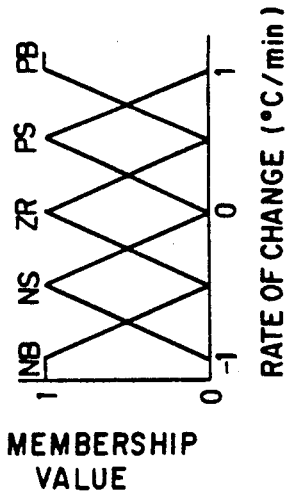
FIG. 14
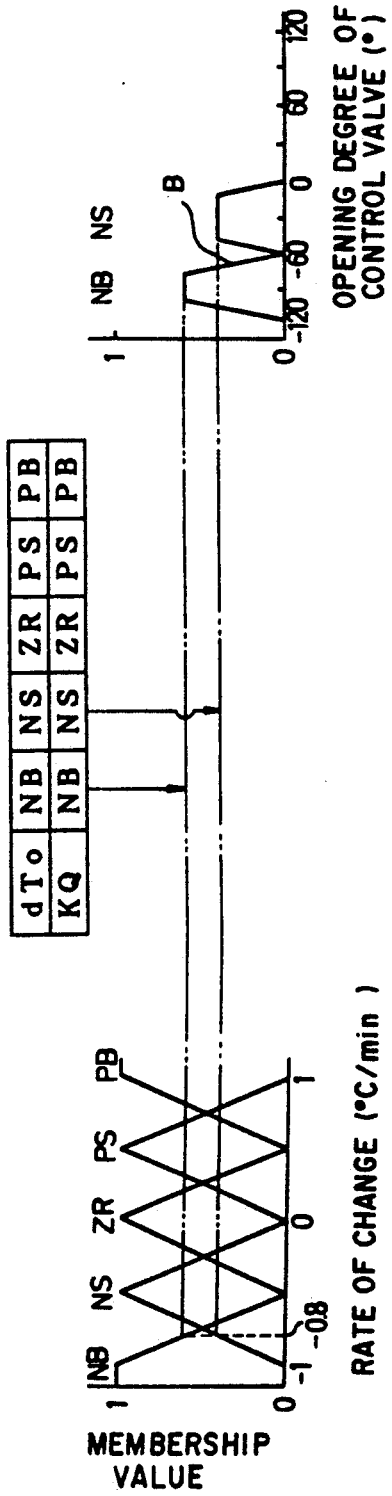

| | | | | | |
|---|---|---|---|---|---|
| dTi | NB | NS | ZR | PS | PB |
| KQ | NB | NS | ZR | PS | PB |

| | | | | | |
|---|---|---|---|---|---|
| dTci | NB | NS | ZR | PS | PB |
| KQ | NB | NS | ZR | PS | PB |

| dTo\ eTo | PB | PS | ZR | NS | NB |
|---|---|---|---|---|---|
| P B | PB | PM | PS | PS | PS |
| P S | PM | PS | PS | PS | ZR |
| Z R | PM | ZR | ZR | ZR | NM |
| N S | ZR | NS | NS | NS | NM |
| N B | NS | NS | NS | NM | NB |

| dTo \ eTo | PB | PS | ZR | NS | NB |
|---|---|---|---|---|---|
| PB | PB | PM | PS | PS | PS |
| PS | PM | PS | PS | PS | ZR |
| ZR | PM | ZR | ZR | PS | NM |
| NS | ZR | NS | NS | NS | NM |
| NB | NS | NS | NS | NM | NB |

| dTo \ eTo | PB | PS | ZR | NS | NB |
|---|---|---|---|---|---|
| PB | PB | PM | PS | PS | PS |
| PS | PM | PS | PS | PS | ZR |
| ZR | PM | ZR | ZR | PS | NM |
| NS | ZR | NS | NS | NS | NM |
| NB | NS | NS | NS | NM | NB |

| dTo \ eTo | PB | PS | ZR | NS | NB |
|---|---|---|---|---|---|
| PB | PB | ☆ | ☆ | ☆ | PS |
| PS | PM | ☆ | ☆ | ☆ | ZR |
| ZR | PM | ☆ | ☆ | ☆ | NM |
| NS | ZR | ☆ | ☆ | ☆ | NM |
| NB | NS | ☆ | ☆ | ☆ | NB |

FIG. 26

| dTo \ dTa | PB | PS | ZR | NS | NB |
|---|---|---|---|---|---|
| PB | PZ | PS | PS | PM | PM |
| PS | ZR | PZ | PS | PS | PM |
| ZR | ZR | ZR | PZ | PS | PS |
| NS | NZ | ZR | ZR | PZ | PS |
| NB | ZS | NZ | ZR | ZR | PZ |

FIG. 27

FIG. 28

| dTo \ dTa | PB | PS | ZR | NS | NB |
|---|---|---|---|---|---|
| PB | ZR | PZ | PZ | PS | PS |
| PS | NZ | ZR | PZ | PZ | PS |
| ZR | NZ | NZ | ZR | PZ | PZ |
| NS | NS | NZ | NZ | ZR | PZ |
| NB | NS | NS | NZ | NZ | ZR |

FIG. 29

| dTo \ dTa | PB | PS | ZR | NS | NB |
|---|---|---|---|---|---|
| PB | NZ | ZR | ZR | PZ | PS |
| PS | NS | NZ | ZR | ZR | PZ |
| ZR | NS | NS | NZ | ZR | ZR |
| NS | NM | NS | NS | NZ | ZR |
| NB | NM | NM | NS | NS | NZ |

| dTo \ eTo | PB | PS | ZR | NS | NB |
|---|---|---|---|---|---|
| PB | PB | PM | PS | PS | PS |
| PS | PM | PS | PS | PS | ZR |
| ZR | PM | ZR | ZR | ZR | NM |
| NS | ZR | NS | NS | NS | NM |
| NB | NS | NS | NS | NM | NB |

CONTROL DEVICE FOR ABSORPTION REFRIGERATOR

FIELD OF THE INVENTION

The present invention relates to an absorption refrigerator (including an absorption cold and hot water machine), and particularly to a control device for an absorption refrigerator.

BACKGROUND OF THE INVENTION

For example, Japanese Patent Laid-Open No. 58-160778 publication discloses a control device for an absorption refrigerator which detects a temperature of a cold-water outlet to control a heating amount to a regenerator, detects an absorption liquid level within the regenerator to control the quantity of rare absorption liquid flowing from an absorber to the regenerator, detects a temperature of a cold-water inlet to obtain a proper value of a heating amount of the regenerator with respect to the temperature or the quantity of rare absorption liquid flowing to the regenerator, and control the heating amount or the quantity of the rare absorption liquid from the proper value.

PROBLEM TO BE SOLVED BY THE INVENTION

In the aforementioned prior art, proportional control or PID control for detecting a temperature of a cold-water outlet to control a heating amount of a regenerator has been generally employed.

In the absorption refrigerator, the relationship between the temperature of the cold-water outlet and the refrigeration ability (refrigeration capacity) is generally as shown in FIG. 36. As will be apparent from FIG. 36, in the case where the temperature of the cold-water outlet is higher than the set value, the refrigeration ability gently increases as the temperature of the cold-water outlet rises, whereas in the case where the aforesaid temperature is lower than the set value, the refrigeration ability abruptly decreases as the aforesaid temperature lowers.

However, in the aforementioned conventional PID control or the proportional control, in both cases where the temperature of the cold-water outlet is higher and lower than the set value, the operation amount of a fuel control valve with respect to a deviation from the set value of the temperature of the cold-water temperature is linear, and therefore, the operation amount (opening degree) of the fuel control valve is similarly controlled. For example, in the case where the lower side than the set value is controlled similar to the higher side than the set value (indicated by the phantom line in FIG. 36), when the temperature of the cold-water outlet is lower than the set value, the operation amount is slow with respect to the temperature of the cold-water outlet, and the considerable lowering of the temperature of the cold-water outlet, i.e., the excessive lowering possibly occurs. In the case where the higher side than the set value is controlled similar to the lower side than the set value (indicated by the dash-dotted contour lines in FIG. 36), when the temperature of the cold-water outlet is higher than the set value, the operation amount is excessively fast with respect to the rise of the temperature of the cold-water outlet, and the considerable lowering of the temperature of the cold-water outlet, i.e., the excessive lowering possibly occurs.

In case of employing the fuzzy inference for the control of the absorption refrigerator, let eTo be the deviation of the temperature of the cold-water outlet and KQ the operation amount of a fuel control valve or a steam control valve of a high temperature generator, then the membership function of the deviation eTo in the conventional fuzzy control is represented in FIG. 3, and the membership function of the operation amount KQ is represented in FIG. 4. The fuzzy rule of the operation amount KQ with respect to the deviation eTo is represented in FIG. 2. In the case where the membership functions and the fuzzy rule are determined as described above, the membership function and the fuzzy rule are symmetrical on the positive and negative sides of the deviation. Therefore, the excessive lowering of the temperature of the cold-water outlet possibly occurs similarly to the case of the aforementioned PID control or proportional control. In FIG. 2, FIG. 3 and FIG. 4, PB stands for Positive Big; PM for Positive Medium; PS for Positive Small; ZR for ZERO; NS for Negative Small; NM for Negative Medium; and NB for Negative Big.

It is an object of the present invention to provide an excellent responsibility to start, stop, variation of load and so on, prevent the excessive lowering of the temperature of cold-water outlet in case of variation of load, and improves a stability of the temperature of the cold-water outlet with respect to the variation of load.

SUMMARY OF THE INVENTION

For solving the aforesaid problems, the present invention provides a control device for an absorption refrigerator forming a refrigeration cycle having an evaporator 4, an absorber 5, a generator 1, a condenser 3 and the like connected to control a heating amount of the generator 1, in which singular or plural amounts of change representative of external conditions such as a temperature of cold-water outlet are detected, and a heating amount of the generator 1 is controlled by the fuzzy logic calculation.

The present invention further provides a control device for an absorption refrigerator comprising a cold-water outlet temperature detector 24 for detecting information representative of magnitude of a load, a memory 28 for storing a control rule for obtaining a heating amount of a generator 1 with respect to information representative of the external conditions, and a fuzzy inference processor 27 for calculating the heating amount of the generator 1 by the fuzzy logic calculation on the basis of the information detected by the detector 24 and the control rule of the memory 28.

The present invention further provides a control device for an absorption refrigerator in which the heating amount of a high temperature generator 1 is controlled by the fuzzy logic calculation on the basis of a deviation from a set value of the cold-water outlet temperature from the evaporator 4, the membership function and the fuzzy rule.

The present invention further provides a control device for an absorption refrigerator in which the membership function and the fuzzy rule are determined between the deviation from the set value of the cold-water outlet temperature from the evaporator 4 and the heating amount of the high temperature generator 1, and the fuzzy inference is made on the basis of the fuzzy rule and the membership function to control the heating amount of the high temperature generator 1 whereby in the case where the cold-water outlet temperature is higher than the set value, the heating amount is slowly changed whereas in the case where the temperature is lower than the set value, the heating amount is rapidly changed.

The present invention further provides a control device for an absorption refrigerator in which the membership function and the fuzzy rule are constituted so that the membership function and the fuzzy rule are determined between the deviation from the set value of the cold-water outlet temperature and the operation amount of a heating-amount control valve 17 of a high temperature generator 1 whereby in the case where the cold-water outlet temperature is higher than the set value, the operation amount is slowly changed whereas in the case where the temperature is lower than the set value, the operation amount is rapidly changed, and the fuzzy interference is made on the basis of the membership function and the fuzzy rule to control a heating amount control valve 17 of the high temperature generator 1.

The present invention further provides a control device for an absorption refrigerator comprising a memory 28 for storing the membership function and the fuzzy rule determined so that when a cold-water outlet temperature is higher than a set value, a heating amount of a high temperature generator 1 with respect to a deviation from the set value of the cold-water outlet temperature is slowly changed whereas when the temperature is lower than the set value, the heating amount is rapidly changed, and a fuzzy inference processor 27 for making a fuzzy interference on the basis of the cold-water outlet temperature, and the membership function and the fuzzy rule of the memory 28 to calculate the operation amount of a heating amount control valve 17.

The present invention further provides a control device for an absorption refrigerator in which a heating amount of a high temperature generator 1 is controlled by a fuzzy logic calculation on the basis of a deviation from a set value of a cold-water outlet temperature from an evaporator 4, a rate of change of the cold-water outlet temperature, a membership function and a fuzzy rule.

The present invention further provides a control device for an absorption refrigerator in which a heating amount of a high temperature generator 1 is controlled by a fuzzy logic calculation on the basis of a deviation from a set value of a cold-water outlet temperature from an evaporator 4, a rate of change of the cold-water outlet temperature, a rate of change of the cold-water inlet temperature to the evaporator 4, a membership function and a fuzzy rule.

The present invention further provides a control device for an absorption refrigerator in which a heating amount of a high temperature generator 1 is controlled by a fuzzy logic calculation on the basis of a deviation from a set value of a cold-water outlet temperature from an evaporator 4, a rate of change of the cold-water outlet temperature, a rate of change of the cold-water inlet temperature to the evaporator 4, a rate of change of the cold-water inlet temperature, a membership function and a fuzzy rule.

The present invention further provides a control device for an absorption refrigerator in which a membership function is constituted between a deviation from a set value of a cold-water outlet temperature from an evaporator 4, a rate of change of the cold-water outlet temperature and an opening degree (operation amount) of a fuel control valve 17, and a matrix-like fuzzy rule is constituted between the deviation and the rate of change, and a fuzzy interference is made on the basis of the cold-water outlet temperature, the deviation, the rate of change, the membership function and the fuzzy rule to control the operation amount of the fuel control valve 17.

The present invention further provides a control device for an absorption refrigerator comprising a memory 28 for storing a membership function constituted between a deviation from a set value of a cold-water outlet temperature, a rate of change of the cold-water outlet temperature and an operation amount of a fuel control valve 17 and a matrix-like fuzzy rule constituted between the rate of change and the deviation, and a fuzzy inference processor 27 for calculating an operation amount of the fuel control valve 17 by making a fuzzy logic calculation on the basis of the rate of change, the deviation, the membership function and the fuzzy rule.

The present invention further provides a control device for an absorption refrigerator in which a membership function is constituted between a deviation from a set value of a cold-water outlet temperature, a rate of change of the cold-water outlet temperature and an operation amount of a fuel control valve 17, and a matrix-like fuzzy rule is determined between the deviation and the rate of change, the fuzzy rule being constituted so that when the deviation is large, the change of the operation amount with respect to the rate of change is large whereas when the deviation is small, the change of the operation amount with respect to the rate of change is small, and a fuzzy inference is made on the basis of the deviation, the rate of change, the membership function and the fuzzy rule to control the operation amount of the fuel control valve 17.

The present invention further provides a control device for an absorption refrigerator in which a membership function is constituted between a rate of change of a cold-water outlet temperature, a rate of change of a temperature of a high temperature generator 1 and an operation amount of a fuel control valve (a heating amount control valve) 17, and a matrix-like fuzzy rule is constituted between the respective rates of change whereby a fuzzy inference is made on the basis of the rates of change, the membership function and the fuzzy rule to control the operation amount of the fuel control valve 17.

The present invention further provides a control device for an absorption refrigerator comprising a memory 28 for storing a deviation from a set value of a cold-water outlet temperature, a rate of change of a cold-water outlet temperature, a rate of change of a temperature of a high temperature generator 1, a membership function of an operation amount of a fuel control valve 17, a matrix-like fuzzy rule between the deviation and the rate of change of the cold-water outlet temperature, and a matrix-like fuzzy rule between the rate of change of the cold-water outlet temperature and the rate of change of the temperature of the high temperature generator 1, and a fuzzy inference processor 27 for making a fuzzy logic calculation on the basis of the deviation, the rates of change, the membership function and the fuzzy rule to calculate the operation amount of the fuel control valve 17.

The present invention further provides a control device for an absorption refrigerator in which a membership function is constituted between a deviation from a set value of a cold-water outlet temperature, a rate of change of the cold-water outlet temperature, a temperature of a high temperature generator 1 and an operation amount of a fuel control valve 17, and a matrix-like fuzzy rule is constituted between the rates of change, whereby when the deviation from the cold-water outlet temperature is small, a fuzzy inference is made on the basis of the deviation, the rates of change, the membership function and the fuzzy rule to control the operation amount of the fuel control valve 17.

The present invention further provides a control device for an absorption refrigerator in which a matrix-like fuzzy rule is constituted between a deviation from a set value of a cold-water outlet temperature and a rate of change of the cold-water outlet temperature, and a matrix-like fuzzy rule is constituted between a rate of change of the cold-water outlet temperature and a rate of change of a temperature of a high temperature generator 1 where the deviation is zero or small with the fuzzy rule, whereby a fuzzy inference is made on the basis of the deviation, the rates of change and the fuzzy rule to control an operation amount of a fuel control valve 17.

When the cold-water outlet temperature, the cold-water inlet temperature or the cooling water inlet temperature is detected during operation of the absorption refrigerator, the fuzzy logic calculation is carried out by the fuzzy inference processor 27 on the basis of the deviation from the set value, or the rate of change of temperature, the membership function and the fuzzy rule to obtain the operation amount of the fuel control valve 17. Accordingly, it is possible to provide an absorption refrigerator in which an opening degree of the fuel control valve 17 can be controlled by the control rule based on human experiences and which has an excellent responsibility with respect to the variation of load or the like.

Particularly, in the case where the cold-water outlet temperature is higher than the set value, the heating amount of the high temperature generator 1 is slowly changed whereas in the case where the cold-water outlet temperature is lower than the set value, the heating amount of the high temperature generator 1 is rapidly changed, whereby the heating amount can be controlled so as to meet the characteristic of the absorption refrigerator and the cold-water outlet temperature can be stabilized.

Furthermore, the fuzzy interference is made on the basis of the cold-water outlet temperature, the membership function and the fuzzy rule whereby the operation amount of the fuel control valve 17 is adjusted. In the case where the cold-water outlet temperature is higher than the set value, the operation amount of the fuel control valve 17 is slowly changed whereas in the case where the cold-water outlet temperature is lower than the set value, the operation amount of the fuel control valve 17 is rapidly changed so that the heating amount of the high temperature generator 1 can be controlled so as to meet the characteristic of the absorption refrigerator and the cold-water outlet temperature can be stabilized.

The fuzzy inference is made by the fuzzy interference processor 28 on the basis of the cold-water outlet temperature, and the membership function and fuzzy rule stored in the memory 28 to obtain the operation amount of the fuel control valve 17 of the high temperature generator 1. The heating amount of the high temperature generator 1 can be controlled so as to meet the characteristic of the absorption refrigerator and the cold-water outlet temperature can be stabilized. Furthermore, the fuzzy inference is made by the fuzzy interference processor 27 on the basis of the deviation from the set value of the cold-water outlet temperature, the rate of change of the cold-water outlet temperature, and the membership function and matrix-like fuzzy rule stored in the memory 28. Therefore, when the cold-water outlet temperature is changed, the fuzzy inference causes the deviation and the rate of change to be interrelated to control the operation amount of the fuel control valve 17, and the cold-water outlet temperature can be stabilized.

Moreover, the fuzzy interference is made on the basis of the matrix-like fuzzy rule and the membership function so that when the deviation is large, the change of the operation amount of the fuel control valve 17 with respect to the rate of change of the cold-water outlet temperature is large whereas when the deviation is small, the operation amount of the fuel control valve 17 with respect to the rate of change is small, the convergence of the cold-water outlet temperature when the cold-water outlet temperature is deviated from the set value is quickened and the cold-water outlet temperature can be further stabilized.

Furthermore, the fuzzy inference is made on the basis of the rate of change of the cold-water outlet temperature as the external condition, the rate of change of the temperature of the high temperature generator 1 as the internal condition, the membership function and the matrix-like fuzzy rule constituted between the respective rates of change. The operation amount of the fuel control valve 17 is controlled, and determination is made whether the refrigeration ability tends to increase or decrease on the basis of the rate of change of the interior of the absorption refrigerator, that is, the temperature of the high temperature generator 1. The operation amount of the fuel control valve 17 is controlled, and the operation amount of the fuel control valve 17 is controlled by the fuzzy inference before the change in the cold-water outlet temperature (external condition) resulting from the variation of the load appears to make it possible to have the cold-water outlet temperature close to the set value as early as possible. In addition, when the operation amount of the fuel control valve 17 is controlled depending on the variation of the load, it is possible to avoid wasteful time and wasteful consumption of fuel resulting from delay.

When the deviation from the set value of the cold-water outlet temperature is small, the fuzzy inference is made on the basis of the deviation from the set value of the cold-water outlet temperature, the rate of change of the cold-water outlet temperature, the rate of change of the temperature of the high temperature generator 1, the membership function and the matrix-like fuzzy rule. The operation amount of the fuel control valve 17 is controlled, and the rate of change of the temperature of the high temperature generator 1 is used whereby determination is made of the change of the refrigeration ability by the fuzzy inference to control the operation amount of the fuel control valve 17, enabling early stabilization of the cold-water outlet temperature to the set value. Furthermore, when the cold-water outlet temperature is close to the set value, it is possible to avoid wasteful time and wasteful consumption of fuel resulting from delay.

Moreover, when the deviation from the set value of the cold-water outlet temperature is zero, the fuzzy inference is made on the basis of the matrix-like fuzzy rule between the rate of change of the cold-water outlet temperature and the rate of change of the temperature of the high temperature generator 1. The rate of change of the temperature of the high temperature generator 1 is used to determine the change of the refrigeration ability, and the operation amount of the fuel control valve 17 is controlled to enable stabilizing the cold-water outlet temperature to the set value.

BRIEF DESCRIPTION OF THE DRAWINGS

FIG. 2 illustrates a control rule with respect to a deviation from a set value of a cold-water outlet temperature in Embodiment 1;

FIG. 3 illustrates a membership function of a fuzzy variable with respect to the deviation;

FIG. 4 illustrates a membership function of a fuzzy variable with respect to an opening degree of a control valve;

FIG. 5 illustrates a fuzzy inference when the deviation is −0.6° C.;

FIG. 12 illustrates a control rule with respect to a rate of change of a cold-water outlet temperature in Embodiment 4;

FIG. 13 illustrates a membership function of a fuzzy variable with respect to the rate of change;

FIG. 14 illustrates a fuzzy inference when the rate of change is −0.8° C./min.;

FIGS. 26, 27, 28 and 29 illustrate the control rule in Embodiment 8;

DESCRIPTION OF THE PREFERRED EMBODIMENTS

A first embodiment of the present invention will be described in detail with reference to the drawings.

Figure 1:
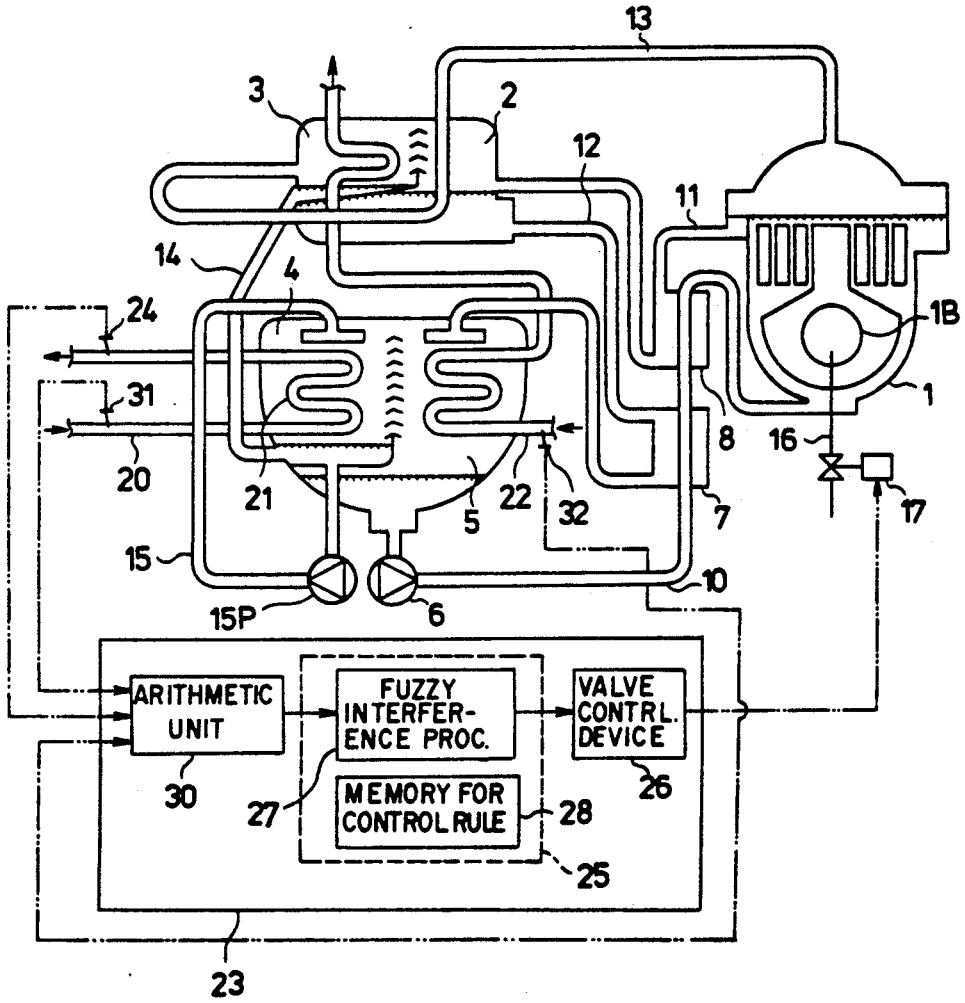
FIG. 1 is a circuit representation of an absorption refrigerator showing one embodiment of the present invention.

FIG. 1 shows a double-utility absorption refrigerator which uses water as a refrigerant and a lithium bromide (LiBr) aqueous solution as an absorber (solution). The refrigerator comprises a high temperature generator provided with a burner 1B, a low temperature generator 2, a condenser 3, an evaporator 4, an absorption unit 5, an absorption liquid pump 6, a low temperature heat exchanger and a high temperature heat exchanger 7 and 8, respectively, a rare absorption liquid pipe 10, an intermediate absorption liquid pipe 11, a concentrated absorption liquid pipe 12, a refrigerant pipe 13, a refrigerant liquid down pipe 14 and a refrigerant liquid circulation pipe 15, which are connected as shown in FIG. 1. A refrigerant pump 15P is provided in the midst of the refrigerant liquid circulation pipe 15. A fuel supply pipe 16 is connected to the burner 1B, and a fuel control valve (a heating amount control valve) 17 is provided in the midst of the fuel supply pipe 16. An evaporator heat exchanger 21 is provided in the midst of a cold water pipe 20. Reference numeral 22 designates a cooling water pipe.

The refrigerator further comprises a microcomputer control panel 23 for the absorption refrigerator and a cold-water outlet temperature detector 24 provided on the cold water pipe 20. The cold-water outlet temperature detector 24 and the fuel control valve 17 are connected to the microcomputer control panel 23. On the microcomputer panel 23 are provided a microprocessor 25 for executing a fuzzy inference on the basis of the cold-water outlet temperature or the like and a control device 26 for the fuel control valve 17. The microprocessor 25 is composed of a fuzzy inference processor (calculation device) 27 and a memory 28 for a control rule. The fuzzy inference processor 27 uses a deviation from a set value of a cold-water outlet temperature to logic-calculate an opening degree, that is, an operation amount of the fuel control valve 17, and outputs the obtained operation amount to the control device 26. The control device 26 controls the opening degree of the fuel control valve 17 on the basis of the operation amount. In this embodiment, the opening degree of the fuel control valve 17 is output from the fuzzy inference processor 27. The memory 28 for the control rule stores a control rule (fuzzy rule) necessary for fuzzy logic calculation executed by the fuzzy inference processor 27 and a membership function. An arithmetic unit 30 calculates a deviation from a set value of a cold-water outlet temperature on the basis of temperature data of the cold-water outlet temperature detector 24.

The fuzzy logic calculation for obtaining the opening degree of the fuel control valve 17 is executed on the basis of the following control rule and membership function. The control rule (fuzzy rule) stored in the memory 28 on the basis of human experiences will be explained hereinafter.

$R_1$: If the cold-water outlet temperature is considerably higher than the set value (for example, 7° C.), that is, if the deviation eTo from the set value of the cold-water outlet temperature is PB (Positive Big), the fuel control valve 17 is immediately opened (PB).

$R_2$: If the cold-water outlet temperature is slightly higher than the set value, that is, if the deviation eTo is PS (Positive Small), the fuel control valve 17 is gradually opened (PS).

$R_3$: If the cold-water outlet temperature is equal to the set value, that is, when the deviation eTo is ZR (Zero), the opening degree of the fuel control valve 17 remains unchanged (ZR).

$R_4$: If the cold-water outlet temperature is slightly lower than the set value, that is, if the deviation eTo is NS (Negative Small), the fuel control valve 17 is gradually closed (NS).

$R_5$: If the cold-water outlet temperature is considerably lower than the set value, that is, if the deviation eTo is NB (Negative Bid), the fuel control valve 17 is immediately opened (NB).

The aforesaid $R_1$ to $R_5$ are control rules, which are as shown in FIG. 2. In FIG. 2, KQ represents the operation amount of the fuel control valve 17.

Among the aforesaid membership functions, the membership functions for qualitatively evaluating the magnitude of the deviation from the set value of the cold-water outlet temperature, that is, the membership functions of fuzzy variables PB, PS, ZR, NS and NB with respect to the aforesaid deviation are defined as shown in FIG. 3.

The membership functions for converting the operation amount of the fuel control valve 27 qualitatively evaluated into the quantitative value, that is, the membership functions of fuzzy variables PB, PS, ZR, NS and NB with respect to the operation amount (opening degree) of the fuel control valve 17 are defined as shown in FIG. 4.

The fuzzy logic calculation is carried out by the fuzzy inference processor 27 using the control rules shown in FIG. 2 and the membership functions shown in FIG. 4 to obtain the operation amount of the fuel control valve 17.

The operation of the absorption refrigerator will be described hereinafter. When the absorption refrigerator is operated, the burner 1B burns and the absorption liquid pump 6 and the refrigerant pump 15P are operated whereby the absorption liquid and refrigerant are circulated similar to the conventional absorption refrigerator. The refrigerant liquid is scattered to the evaporator heat exchanger 21 by the evaporator 4, and cold water lowered in temperature in the evaporator heat exchanger 21 is supplied to loads.

The control of the heating amount of the high temperature generator 1 when the absorption refrigerator is being operation will be described below.

During the operation of the absorption refrigerator, the cold-water outlet temperature detector 24 detects a temperature of cold water from the evaporator 4. Temperature data of cold water is sent to the fuzzy inference processor 27 of the control panel 23. In the fuzzy inference processor 27, the membership functions of fuzzy variables with respect to the aforesaid temperature stored in advance in the memory 28 are used to calculate the membership value at the cold-water outlet temperature. When the membership value is in the first part, i.e., $R_1$ of the control rules ($R_1$ to $R_5$), the rate which fulfills that the cold-water outlet temperature is considerably higher than the set value is calculated by the fuzzy logic product. The rate by which the first part vary the control rule ($R_1$ to $R_5$) is multiplied by the membership function of the fuzzy variables (PB, PS, ZR, NS and NB) to correct the membership function.

The operation amount of the fuel control valve 17 according to the deviation from the set value of the cold-water outlet temperature, that is, the optimum opening degree of the fuel control valve 17 is obtained by the corrected membership function of the control rule.

When the deviation of the cold-water outlet temperature is for example, −0.6° C., the membership value A as shown in FIG. 5 is obtained by the membership function and the control rule, and the operation amount of the fuel control valve 17 (the opening degree of the control valve) is obtained from the center of gravity (g) of the membership value A. The aforesaid operation amount is output to the control device 26, and an opening-degree signal output from the control device 26 is changed and the opening degree of the fuel control valve 17 maintained at the optimum opening degree.

According to the aforementioned embodiment, human experiences with respect to the control of the fuel control valve 17 corresponding to the deviation from the set value of the cold-water outlet temperature are stored as the control rules in the memory 28. The opening degree of the fuel control valve 17 on the basis of the human experience can be adjusted by the calculation of the membership function and the heating amount of the high temperature generator 1 can be controlled in response to the deviation from the set value of the cold-water outlet temperature, as a consequence of which the coefficient of result of the absorption refrigerator can be improved.

Figures 6, 7:
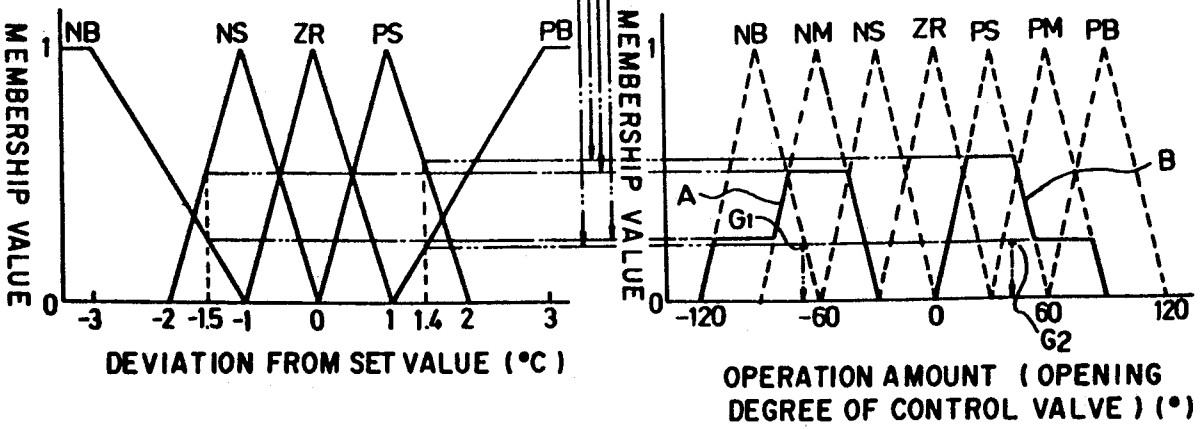
FIG. 6 illustrates a control rule with respect to a deviation from a set value of a cold-water outlet temperature in Embodiment 2.
FIG. 7 illustrates a fuzzy inference when the deviation is −1.5° C. and +1.4° C.

Next, a second embodiment will be described in which control rules as shown in FIG. 6 are determined between a deviation eTo from a set value of a cold-water outlet temperature and an operation amount (opening degree) KQ of the fuel control valve 17, and the control rules are stored in the memory 28 and operated. In FIG. 6, PM stands for Positive Medium, and NM stands for Negative Medium. In FIG. 6, when the deviation is PB, the operation amount is not set to PB but PM to suppress the operation amount. When the deviation is NS, the operation amount is not set to NS but NM to increase the operation amount.

The membership functions for qualitatively evaluating the deviation from the set value of the cold-water outlet temperature, that is, the membership functions of the fuzzy variables PB, PS, ZR, NS and NB are as shown in FIG. 3 previously mentioned. In addition, the membership functions for converting the operation amount of the fuel control valve 17 qualitatively evaluated into the quantative value, that is, the membership functions of the fuzzy variables PB, PM, PS, ZR, NS, NM and NB with respect to the opening degree of the fuel control valve 17 are as shown in FIG. 4 likewise previously mentioned.

The fuzzy logic calculation is carried out by the fuzzy inference processor 27 on the basis of the aforementioned control rules, the membership functions and the deviation from the set value of the cold-water output temperature to obtain the operation amount of the fuel control valve 17.

The operation of the absorption refrigerator will be described hereinafter. In the case where, for example, the cold-water output temperature is lower than the set value during operation of the absorption refrigerator, in the stage of the fuzzy interference for determining the operation amount KQ of the fuel control valve 17, the operation amount is large even the deviation is small by the control rules shown in FIG. 6, and the fuzzy inference processor 27 outputs a signal of a large operation amount to the control device 26. In case where the deviation is −1.5° C., for example, the fuzzy inference is carried out as indicated by the phantom line in FIG. 7 to obtain the membership value A with respect to the operation amount. The operation amount of the fuel control valve 17 is determined from the center of gravity $G_1$ of the membership value A. Also in the case where the cold-water outlet temperature is slightly lower than the set value, the membership value of the operation amount is determined by the fuzzy variables ZR and NM, and the operation amount of the fuel control valve 17 is rapidly decreased as the cold-water outlet temperature lowers. Because of this, the opening degree of the fuel control valve 17 is rapidly changed according to the change of the refrigeration load. In the case where the cold-water outlet temperature is higher than the set value, the operation amount is small even if the deviation is large by the control rules shown in FIG. 6 in the stage of the fuzzy inference, and the fuzzy inference processor 27 outputs a signal of a small operation amount to the control device 26. If the deivation is 1.4° C., for example, the fuzzy inference is carried out as indicated by the dash-dotted contour lines in FIG. 7 to obtain the membership value B with respect to the operation amount. Then, the operation amount of the fuel control valve 17 is determined from the center of gravity $G_2$ of the membership value. Also in the case where the cold-water outlet temperature is considerably lowered, the membership value of the operation amount is determined by the fuzzy variables PM and PS, and the operation amount of the fuel control valve 17 is slowly increased as the cold-water outlet temperature rises. Because of this, the opening degree of the fuel control valve 17 is slowly changed according to the change of the refrigeration load.

According to the second embodiment, the control rules of the operation amount of the fuel control valve 17 with respect to the deviation from the set value of the cold-water outlet temperature are set as shown in FIG. 6 so that when the cold-water outlet temperature is considerably higher than the set value, that is, when the deviation is PB, the operation amount is set to PM whereas when the cold-water outlet temperature is slightly lower than the set value, that is, when the deviation is NS, the operation amount is set to NM. Therefore, in the case where the cold-water outlet temperature is higher than the set value, the operation amount of the fuel control valve 17 according to the fuzzy inference is slowly changed, whereas in case where the temperature is low, the operation amount is rapidly changed whereby the heating amount of the high temperature generator 1 can be adjusted so as to meet the characteristic of the absorption refrigerator. It is possible to avoid the excessive lowering of the cold-water outlet temperature and to supply cold water in a stable manner even if a variation of load should occur.

Figures 8, 9:
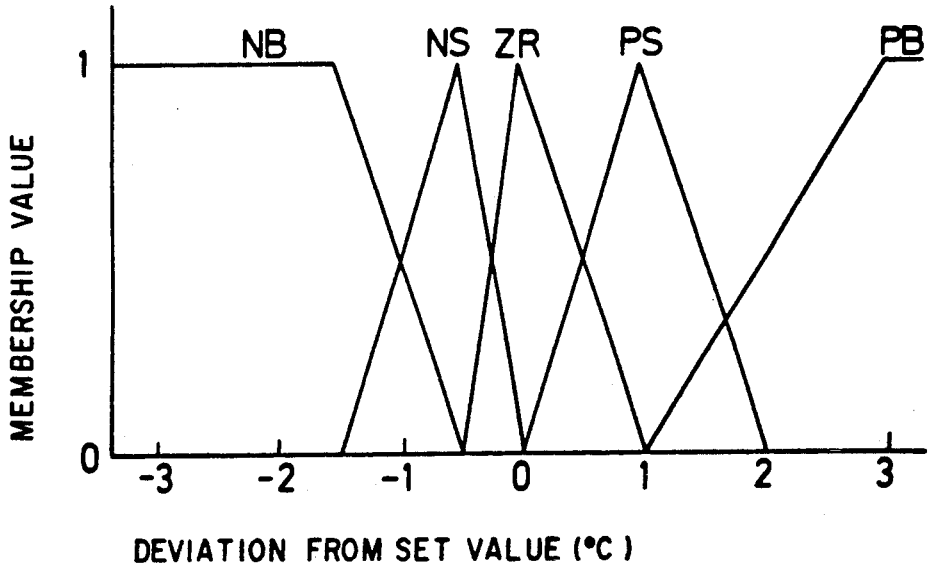
FIG. 8 illustrates a control rule with respect to a deviation from a set value of a cold-water outlet temperature in Embodiment 3.
FIG. 9 illustrates a membership function of a fuzzy variable with respect to the deviation.
Figure 10:
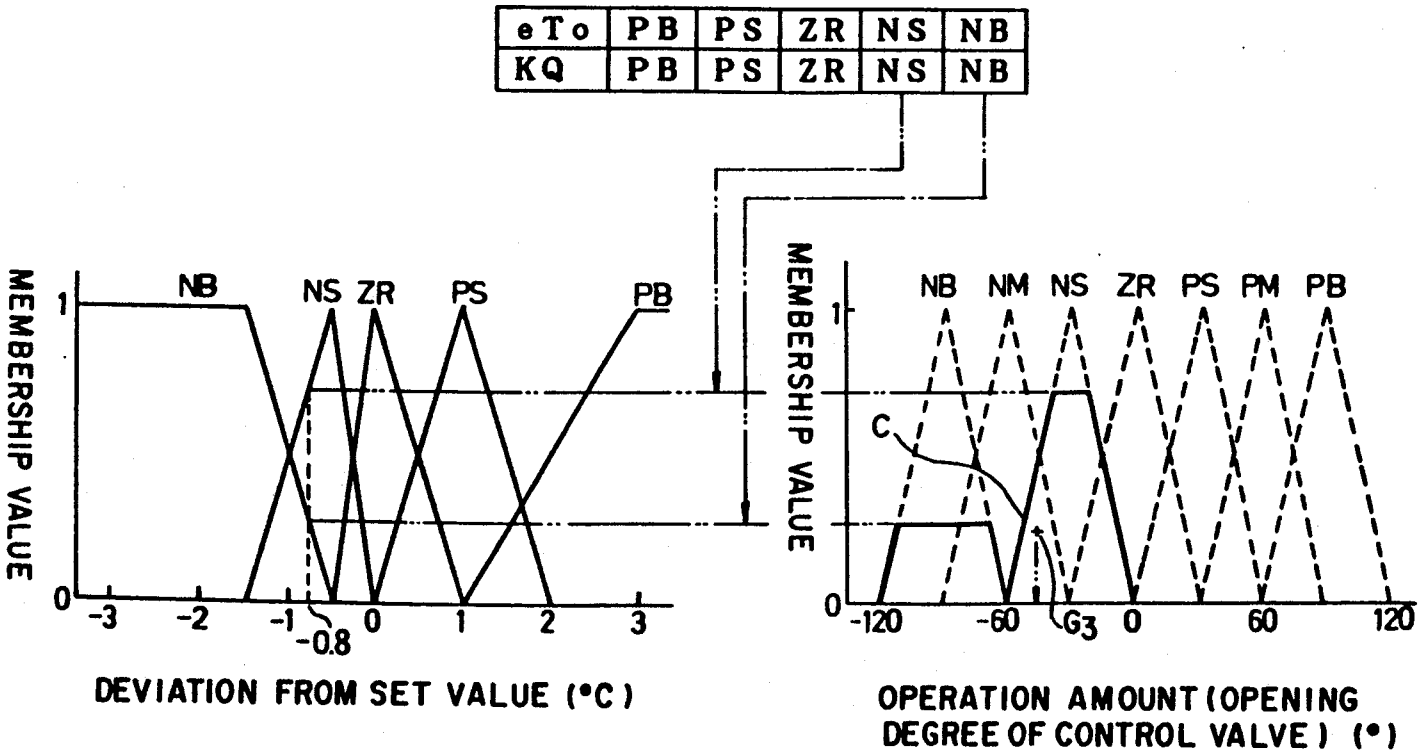
FIG. 10 illustrates a fuzzy inference when the deviation is −0.8° C.
Figure 11:
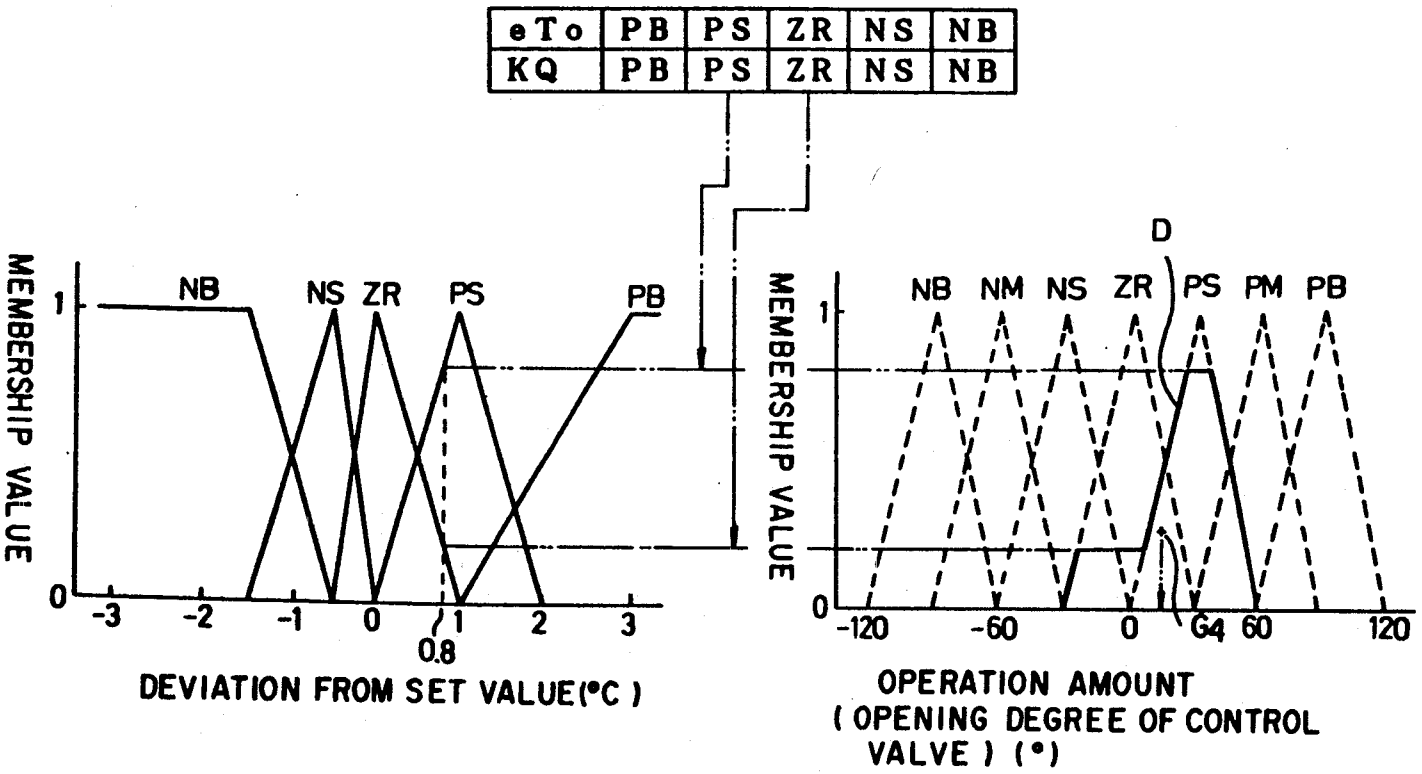
FIG. 11 illustrates a fuzzy inference when the deviation is +0.8° C.

A third embodiment will be described hereinafter in which a membership value is different between a positive deviation from a set value of a cold-water outlet temperature and a negative deviation there from. Stored in the memory 28 are membership functions of fuzzy variables PB, PS, ZR, NS and NB with respect to the deviation from the set value of the cold-water outlet temperature shown in FIG. 9. Also stored in the memory are membership functions of fuzzy variables PB, PM, PS, ZR, NS, NM and NB with respect to the operation amount (opening degree) of the fuel control valve 17 shown in FIG. 4 and the control rules shown in FIG. 8. As will be apparent from FIG. 9, there is provided a difference in the stage of determining a label of the membership functions between the case where the cold-water outlet temperature is higher than the set value, i.e., where the deviation from the set value is positive and the case where the cold-water outlet temperature is lower than the set value, i.e. where the deviation is negative. When the aforesaid deviation is −0.8° C., for example, the fuzzy inference is carried out as shown in FIG. 10 to obtain a membership value C with respect to the operation amount of the fuel control valve 17. The operation amount is determined from the center of gravity $G_3$ of the membership value C. In the case where the cold-water outlet temperature is lower than the set value, the operation amount is rapidly decreased. Because of this, the opening degree of the fuel control valve 17 is rapidly changed according to the change of the refrigeration load. When the deviation is 0.8° C., for example, the fuzzy inference is carried out as shown in FIG. 11, and a membership value D with respect to the operation amount of the fuel control valve 17 is obtained. The operation amount is determined from the center of gravity $G_4$ of the membership value D. In the case where the cold-water outlet temperature is higher than the set value, the operation amount slowly increases. Because of this, the opening degree of the fuel control valve 17 is slowly changed according to the change of the refrigeration load.

According to the aforementioned third embodiment, the difference is provided in the stage of determining a label so that in the case where the deviation is positive, evaluation of an absolute value of the deviation is small even if the deviation is large, whereas in the case where the deviation is negative, evaluation of an absolute value of the deviation is large even if the deviation is small. Because of this, in the case where the cold-water outlet temperature is higher than the set value, the operation amount of the fuel control valve 17 after the fuzzy logic calculation is slowly changed, whereas in the case where the temperature is lower than the set value, the operation amount is rapidly changed. Thereby, the heating amount of the high temperature generator 1 can be adjusted so as to meet the characteristic of the absorption refrigerator with respect to the rise and lowering of the cold-water outlet temperature, thus enabling the excessive lowering of the cold-water outlet temperature to be avoided to supply cold water in a stable manner.

In the following, a fourth embodiment of the present invention will be described in which the operation amount of the fuel control valve 17 is subjected to fuzzy inference using a deviation from a set value of a cold-water outlet temperature and a rate of change of the cold-water outlet temperature. Stored in the memory are, in addition to the control rules in the aforementioned first embodiment, control rules with respect to a rate of change of the following cold-water outlet temperature on the basis of the human experience and membership functions.

$R_1$: If the cold-water outlet temperature is rapidly risen, that is, if the rate of change dTo of the cold-water outlet temperature is PB, the fuel control valve 17 is immediately opened (PB).

$R_2$: If the cold-water outlet temperature is slightly risen, that is, if the rate of change is PS, the fuel control valve 17 is gradually opened (PS).

$R_3$: If the cold-water outlet temperature remains unchanged, that is, if the rate of change is ZR, the fuel control valve 17 stays as it is (ZR).

$R_4$: If the cold-water outlet temperature is slightly lowered, that is, if the rate of change is NS, the fuel control valve 17 is gradually closed (NS).

$R_5$: If the cold-water outlet temperature is rapidly lowered, that is, the rate of change is NB, the fuel control valve 17 is immediately opened (NB).

Control rules of the aforesaid $R_1$ to $R_5$ are as shown in FIG. 12.

Membership functions of fuzzy variables PB, PS, ZR, NS and NB with respect to rates of change of the cold-water outlet temperature are as shown in FIG. 13. The membership functions of the fuzzy variables PB, PS, ZR, NS and NB with respect to the opening degree of the fuel control valve 17 are as shown in FIG. 4 previously mentioned.

The fuzzy logic calculation is carried out by the fuzzy inference processor 27 using the control rules shown in FIG. 12 and the membership functions shown in FIG. 13 to obtain the operation amount.

The control rules with respect to the rates of change of the cold-water outlet temperature, the membership functions, the control rules with respect to the deviation from the set value of the cold-water outlet temperature and the membership functions are stored in the memory 28 as described above. The arithmetic unit 30 calculates a rate of change on the basis of the cold-water outlet temperature (the change in the cold-water outlet temperature for 1 minute) (°C./min) in addition to the deviation. The fuzzy logic calculation is carried out by the fuzzy inference processor 27 by the control rules and the member ship functions on the basis of the deviation from the set value of the cold-water outlet temperature similarly to the aforementioned first embodiment to obtain the membership values of the operation amount of the fuel control valve 17 according to the deviation. When the deviation is −0.6° C., the membership value is A in FIG. 5 similarly to the first embodiment. Further, the fuzzy logic calculation is carried out by the fuzzy inference processor 27 by the control rules shown in FIG. 12 and the membership functions shown in FIGS. 4 and 13 on the basis of the rates of change of the cold-water outlet temperature to obtain the membership values of the operation amount of the fuel control valve 17 according to the rates of change. When the rate of change is −0.8° C./min, for example, the membership value B is obtained as shown in FIG. 14. The logic sum of the membership values A and B of the operation amounts are obtained by the fuzzy inference processor 27. The operation amount is obtained from the center of gravity of the logic sum and is output to the control device 26. A signal of an opening degree is output from the control device 26 to the fuel control valve 17 on the basis of the operation amount, and the optimum opening degree is maintained.

According to the aforementioned fourth embodiment, the human experiences with respect to the deviation from the set value of the cold-water outlet temperature and the control of the fuel control valve 17 corresponding to the rate of change are stored as control rules in the memory 28, and the opening degree of the fuel control valve 17 based on the human experieneces can be obtained by the fuzzy inference. Even if the cold-water outlet temperature is changed as a result of the change of load, the heating amount of the high temperature generator 1 according to the change can be adjusted, as a consequence of which the cold-water outlet temperature can be further stabilized.

A fifth embodiment will be described hereinafter in which the operation amount of the fuel control valve 17 is subjected to the fuzzy inference using a deviation from a set value of a cold-water outlet temperature, a rate of change of the cold-water outlet temperature and a rate of change of a cold-water inlet temperature. Reference numeral 31 designates a cold-water inlet temperature detector mounted on the inlet side cold water pipe 20 of the evaporator 4. The detector 31 outputs temperature data detected to the arithmetic unit 30 of the control panel 23. Stored in the memory 28 are, in addition to the control rules in the first and fourth embodiments, control rules with respect to rates of change of the cold-water inlet temperature based on the human experiences and membership functions.

Figures 15, 16, 17:
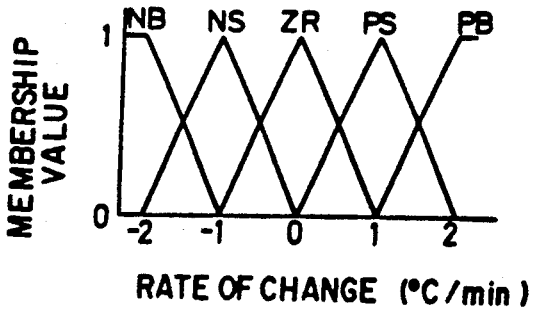
FIG. 15 illustrates a control rule with respect to a rate of change of a cold-water inlet temperature in Embodiment 5.
FIG. 16 illustrates a control rule with respect to a rate of change of a cooling water inlet temperature in Embodiment 6.
FIG. 17 illustrates a membership function of a fuzzy variable with respect to a rate of change.

The control rules with respect to the rates of change of the cold-water inlet temperature and membership functions will be described hereinafter. The control rules comprise the following $R_1$ to $R_5$, which are shown in FIG. 15.

$R_1$: If the cold-water inlet temperature is rapidly risen, that is, if the rate of change dTi of the cold water inlet temperature is PB, the fuel control valve 17 is immediately opened (PB).

$R_2$: If the cold-water inlet temperature is slightly risen, that is, if the rate of change is PS, the fuel control valve 17 is gradually opened (PS).

$R_3$: If the cold-water inlet temperature remains unchanged, that is, if the rate of change is ZR, the fuel control valve 17 stays at it is (ZR).

$R_4$: If the cold-water inlet temperature is slightly lowered, that is, if the rate of change is NS, the fuel control valve 17 is gradually closed (NS).

$R_5$: If the cold-water inlet temperature is rapidly lowered, that is, if the rate of change is NS, the fuel control valve 17 is immediately closed (NB).

The membership functions of the fuzzy variables PB, PS, ZR, NS and NB with respect to the rates of change of the cold-water inlet temperature are those shown in FIG. 13 previously mentioned. The membership functions of the fuzzy variables PB, PS, ZR, NS and NB with respect to the opening degree of the fuel control valve 17 are also those shown in FIG. 4 previously mentioned.

The fuzzy logic calculation is carried out by the fuzzy inference processor 27 using control rules shown in FIG. 15 and the membership functions shown in FIGS. 4 and 13 previously mentioned to obtain the operation amount.

The deviation from the set value of the cold-water outlet temperature, the control rules in connection with the rates of change of the cold-water outlet temperature and the rates of change of the cold-water inlet temperature and the membership functions are stored in the memory 28 as described above. The arithmetic unit 30 also calculates the rates of change of the cold-water inlet temperature on the basis of the cold-water inlet temperature.

The fuzzy logic calculation is carried out by the fuzzy inference processor 27 by the control rules and the membership functions on the basis of the deviation from the set value of the cold-water outlet temperature and the rates of change of the cold-water outlet temperature, similarly to the aforementioned fourth embodiment, when the absorption refrigerator is operated. The membership values of the operation amount of the fuel control valve 17 corresponding to the aforesaid deviation and rates of change are obtained. Furthermore, the fuzzy logic calculation is carried out by the fuzzy inference processor 27 using the control rules shown in FIG. 15 and the membership functions shown in FIGS. 4 and 13 on the basis of the rates of change of the cold-water inlet temperature to obtain the membership values of the operation amount of the fuel control valve 17 corresponding to the rates of change. For example, in case of the MAX center of gravity calculation method, the deviation from the set value of the cold-water outlet temperature, and the logic sum of membership values of the operation amount of the fuel control valve 17 on the basis of the rates of change of the cold-water outlet temperature and the rates of change of the cold-water inlet temperature are obtained by the fuzzy inference processor 24 to obtain the operation amount from the center of gravity thereof. The operation amount is output to the control device 26. An opening-degree signal is output to the fuel control valve 17 from the control device 26 on the basis of the control amount, and the opening degree is kept at optimum also corresponding to the rate of change of the cold-water inlet temperature.

According to the fifth embodiment, the human experiences with respect to the control of the fuel control valve 17 corresponding to the rates of change of the cold-water inlet temperature, in addition to the deviation from the set value of the cold-water outlet temperature and the rates of change of the cold-water outlet temperature, are stored as control rules in the memory 28, so that when the cold-water inlet temperature is changed, the adjustment of the opening degree of the fuel control valve 17 based on the human experience can be made by the calculation of the membership functions. In case where the cold-water inlet temperature is changed as a result of the change of the load, the heating amount of the high temperature generator 1 can be adjusted according to the aforesaid change, and the cold-water outlet temperature can be further stabilized despite the change of load.

A sixth embodiment of the present invention will be described hereinafter in which the operation amount of the fuel control valve 17 is subjected to the fuzzy inference using a deviation from a set value of a cold-water outlet temperature, rates of change of the cold-water outlet temperature, rates of change of the cold water inlet temperature and rates of change of the cold-water inlet temperature to the aborption unit 5. Reference numeral 32 denotes a cold-water inlet temperature detector mounted on the cold water pipe 22 on the inlet side of the absorption unit 5. The temperature detector 32 outputs temperature data to the arithmetic unit 30. The arithmetic unit 30 calculates rates of change of the cold-water inlet temperature on the basis of the input temperature data in addition to the deviation from the set value of the cold-water outlet temperature, the cold-water outlet temperature and the rates of change of the cold-water inlet temperature. Stored in the memory 28 are control rules and membership functions with respect to the change by time of a cooling water inlet temperature, that is, rates of change of the cooling water inlet temperature on the basis of the human experiences in addition to the control rules and the membership functions in the first, fourth and fifth embodiments.

In the following, the control rules and membership functions with respect to the rates of change of the cooling-water inlet temperature will be described. The control rules comprise the following $R_1$ to $R_5$, which are shown in FIG. 16.

$R_1$: If the cooling-water inlet temperature is rapidly risen, that is, the rate of change dTci of the cooling-water inlet temperature is PB, the fuel control valve 17 is immediately opened (PB).

$R_2$: If the cooling-water inlet temperature is slightly risen, that is, the rate of change is PS, the fuel control valve 17 is gradually opened (PS).

$R_3$: If the cooling water inlet temperature remains unchanged, that is, the rate of change is ZR, the fuel control valve 17 stays as it is (ZR).

$R_4$: If the cooling-water inlet temperature is slightly lowered, that is, the rate of change is NS, the fuel control valve 17 is gradually closed (NS).

$R_5$: If the cooling-water inlet temperature is rapidly lowered, that is, the rate of change is NB, the fuel control valve 17 is immediately opened (NB).

Membership functions of fuzzy variables PB, PS, ZR, NS and NB with respect to rates of change of the cooling-water inlet temperature are those as shown in FIG. 17. The membership functions of the fuzzy variables PB, PS, ZR, NS and NB with respect to the opening degree of the fuel control valve 17 are those shown in FIG. 4 previously mentioned.

The fuzzy logic calculation is carried out by the fuzzy inference processor 27 using the control rules shown in FIG. 16 and the membership functions shown in FIGS. 4 and 17 to obtain the operation amount.

Stored in the memory are the control rules for the rates of change of the cooling-water inlet temperature and the membership functions in addition to the control rules and membership functions shown in the fifth embodiment, as described above.

Figure 18:
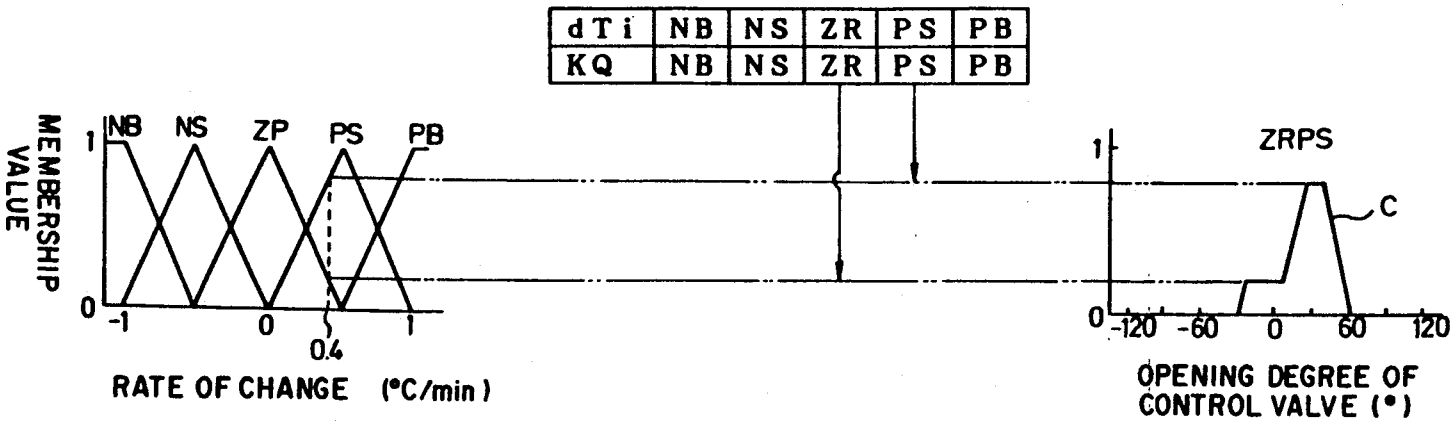
FIG. 18 illustrates a fuzzy inference when the rate of change of the cold-water inlet temperature is +0.4° C./min.

The fuzzy inference calculation is carried out by the fuzzy inference processor 27 by the control rules and the membership functions on the basis of the deviation from the set value of the cold-water outlet temperature and the rates of change of the cold-water outlet temperature and cooling-water inlet temperature, similarly to the fifth embodiment, when the absorption refrigerator is operated to obtain membership values of the operation amount of the fuel control valve 17 according to the aforesaid deviation and the rates of change. When the deviation from the set value of the cold-water outlet temperature is −0.6° C., for example, the fuzzy inference is carried out as shown in FIG. 5 so that the membership value of the operation amount of the fuel control valve 17 caused by the deviation is as in A. When the rate of change of the cold-water outlet temperature is −0.8° C./min, for example, the fuzzy inference is carried out as shown in FIG. 14 so that the membership value of the operation amount of the fuel control valve 17 caused by the rate of change is as in B. Further, when the rate of change of the cold-water inlet temperature is 0.4° C./min, for example, the fuzzy inference is carried out as shown in FIG. 18, and the membership value of the operation amount of the fuel controlvalve 17 caused by the rate of change is as in C.

Figure 19:
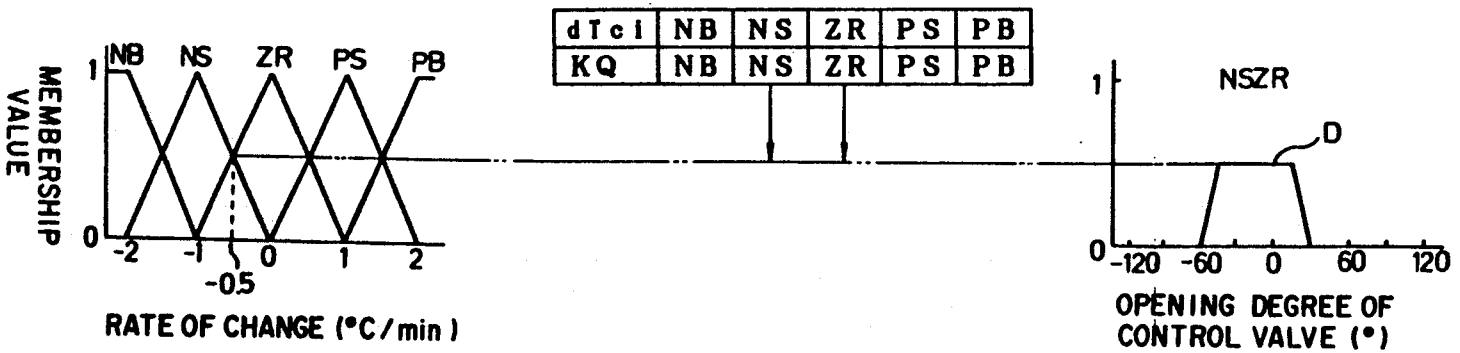
FIG. 19 illustrates a fuzzy inference when the rate of change of the cooling water inlet temperature is −0.5° C./min.

The fuzzy inference calculation is further carried out by the fuzzy inference processor 27 using control rules and membership functions on the basis of rates of change of the cooling-water inlet temperature to obtain the operation amount of the fuel control valve 17 corresponding to the rate of change of the cooling-water inlet temperature. When the rate of change of the cooling-water inlet temperature is −0.5° C./min, for example, the membership value of the operation amount of the fuel control valve 17 caused by the rate of change is as in D in FIG. 19 according to the fuzzy inference. In case of, for example, the MAX center of gravity calculation, the logic sum of the membership values A, B, C and D of the operation amount of the fuel control valve 17 caused by the aforementioned deviations and rates of change is obtained. This logic sum is shown at E in FIG. 20 which is a contour obtained when the membership values A, B, C and D are placed one upon another, and the operation amount of the fuel control valve 7 is determined from the center of gravity C of the logic sum E.

The thus obtained operation amount is output to the control device 26, and an opening-degree signal is output from the control device 26 to the fuel control valve 17 on the basis of the operation amount whereby the opening degree thereof is maintained at optimum also corresponding to the rate of change of the cooling water inlet temperature.

According to the sixth embodiment, the human experiences with respect to the control of the fuel control valve corresponding to the rate of change of the cooling water inlet temperature are stored as control rules in the memory 28 in addition to the deviation from the set value of the cold-water outlet temperature and the rates of change of the cold-water outlet temperature and cooling-water inlet temperature. In the case where the cooling-water inlet temperature is changed, the adjustment of the opening degree of the fuel control valve 17 based on the human experiences can be made by the fuzzy inference calculation, and the heating amount of the high temperature generator 1 can be adjusted in response to the change. The cold water can be supplied to the load in a stable manner despite the change in temperature of the cooling water.

While in the sixth embodiment, the fuzzy inference has been carried out on the basis of the deviation from the set value of the cold-water outlet temperature, the rates of change of the cold-water outlet temperature, the cold-water inlet temperature and the cold-water inlet temperature to adjust the opening degree of the fuel control valve 17, it is to be noted that the fuzzy inference may be carried out on the basis of the deviation and the rates of change of the cold-water inlet temperature, or the deviation and the rates of change of the cooling-water inlet temperature, or the deviation and the rates of change of the cold-water outlet temperature and cooling-water inlet temperature, or the deviation and the rates of change of the cold-water inlet temperature and cooling-water inlet temperature to obtain the operation amount of the fuel control valve, and the opening degree of the fuel control valve 17 may be adjusted.

While in the aforementioned respective embodiments, a description has been made of the absorption refrigerator having the high temperature generator 1 provided with the burner 1B, it is to be noted that even in an absorption refrigerator in which a high temperature generator using a high temperature steam is provided as a heating source, and an opening degree of a steam control valve provided on a steam supply pipe is adjusted to control a quantity of steam supplied to the high temperature generator, the opening degree of the steam control valve can be adjusted by the fuzzy inference similarly to the fuel control valve of the above-described embodiments to thereby obtain the similar function and effect. Also in the absorption refrigerator, the fuel control valve can be controlled on the basis of the fuzzy inference as in the aforementioned embodiments when cold water is supplied to obtain the similar function and result. Moreover, in the case where the fuzzy inference is carried out on the basis of the control rules shown in FIG. 6 and the membership functions shown in FIGS. 4 and 9 to obtain the operation amount of the fuel control valve 17, the cold-water outlet temperature can be further stabilized.

Next, a seventh embodiment will be described.

Figures 20, 21:
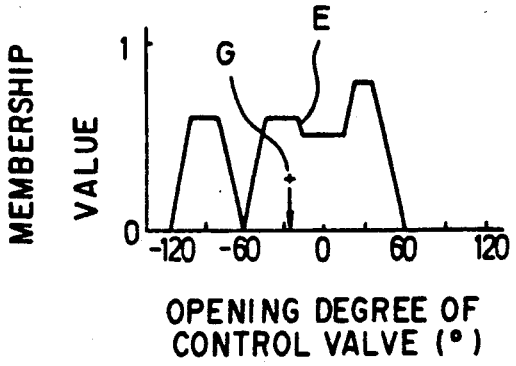
FIG. 20 illustrates how to obtain an operation amount of a fuel control valve by a MAX center-of-gravity calculation method from a deviation from a set value of a cold-water outlet temperature, a rate of change of a cold-water outlet temperature, a rate of change of a cold-water inlet temperature and a rate of change of a cooling-water inlet temperature.
FIG. 21 illustrates a matrix-like control rule constituted between a deviation from a set value of a cold-water outlet temperature and a rate of change of a cold-water outlet temperature.

With respect to control rules, matrix-like control rules between a deviation eTo from a set value of a cold-water outlet temperature shown in FIG. 21 and a rate of change dTo of the cold-water outlet temperature are constituted on the basis of the human experiences, the control rules being stored in the memory 28. In FIG. 21, for example, the eTo changes from PB to PS, ZR, . . . whereas the opening degree of the fuel control valve 17 with respect to the dTo is suitably selected. When the deviation is large, that is, when the cold-water outlet temperature is greatly deviated from the set value, the operation amount KQ of the fuel control valve 17 with respect to the rate of change is set large whereas when the deviation is small, that is, when the cold-water outlet temperature is close to the set value, the operation amount KQ of the fuel control valve 17 with respect to the rate of change is set small. That is, as may seen from FIG. 21, when the deviation eTo is PB, the operation amount KQ with respect to the rate of change dTo is in the range of from PB to NS, and when the deviation eTo is PS, the operation amount KQ with respect to the rate of change dTo is in the range of from PM to NS. The range of the operation amount KQ when the deviation is PB is larger than that of PS. When the deviation eTo is negative, the range of the operation amount KQ when the deviation is NB is larger than that of NS.

The deviation from the set value of the cold-water outlet temperature and the membership functions with respect to the rate of change of the cold-water outlet temperature are as shown in FIGS. 3 and 13 previously mentioned. The membership functions of the fuzzy variables PB, PM, PS, ZR, NS, NM and NB with respect to the opening degree of the fuel control valve 17 are also as shown in FIG. 4 previously mentioned.

The fuzzy logic calculation, that is, the fuzzy inference is carried out by the fuzzy inference processor 27 on the basis of the cold-water outlet temperature using the aforesaid control rules and membership functions to obtain the operation amount of the fuel control valve 17. When the absorption refrigerator is operated, the burner 1B of the high temperature generator 1 burns and the absorption liquid pump 6 and the refrigerant pump 15P are operated. The absorption liquid and refrigerant liquid are circulated, similarly to the conventional absorption refrigerator, and the refrigerant liquid flows from the condenser 3 to the evaporator 4. The refrigerant liquid sent to the evaporator 4 is scattered to the evaporator heat exchanger 21, and cold water lowered in temperature at the evaporator heat exchanger 21 is supplied to the load via the cold water pipe 20.

Figure 22:
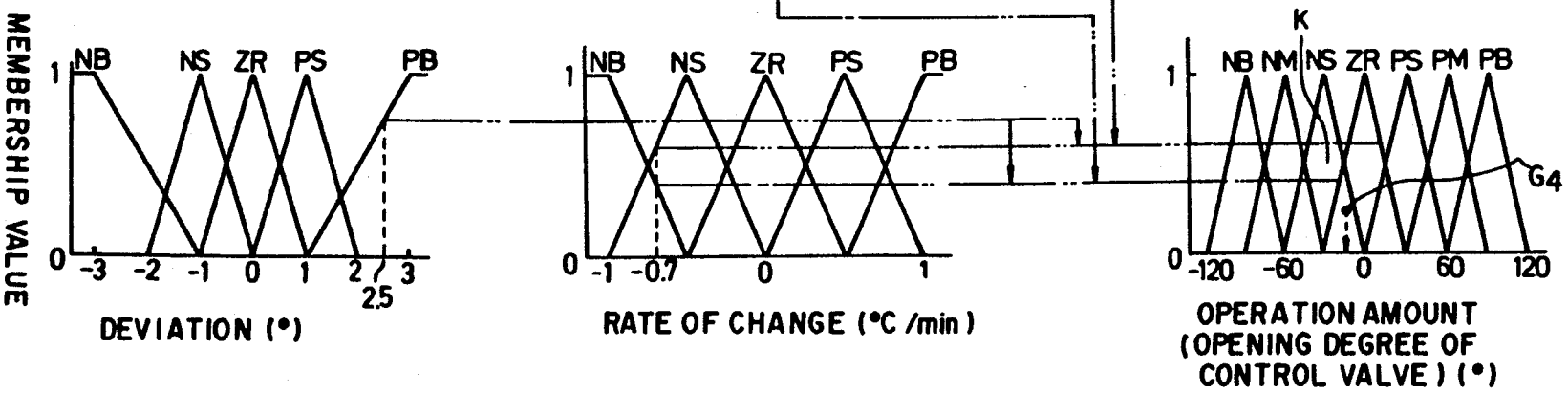
FIG. 22 illustrates a fuzzy inference when a deviation from a set value of a cold-water outlet temperature is 2.5° C. and a rate of change is −0.7° C./min.

In the case where the deviation eTo from the set value of the cold-water outlet temperature is 2.5° C., for example, and the rate of change dTo of the cold-water outlet temperature is −0.7° C., for example, the fuzzy inference is carried out by the fuzzy inference processor 27 on the basis of the control rules and the membership functions. For example, in the MIN-MAX center of gravity calculation method, the fuzzy inference shown in FIG. 22 is carried out. The operation amount of the fuel control valve 17 is determined from the center of gravity $G_4$ of the membership value K with respect to the operation amount of the fuel control valve 17.

Figure 23:
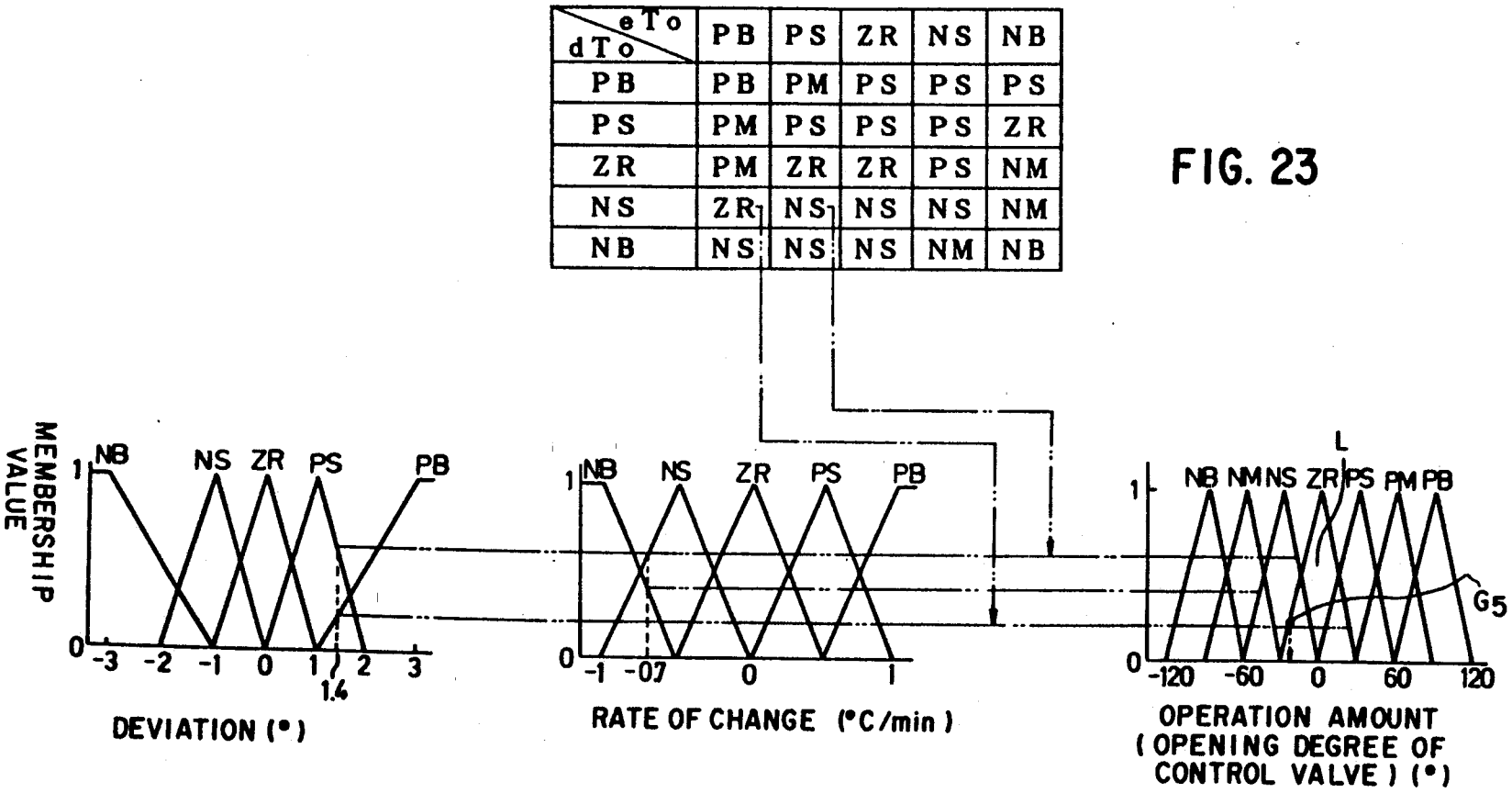
FIG. 23 illustrates a fuzzy inference when the deviation is 1.4° C. and the rate of change is −0.7° C./min.

In the case where the deviation eTo is decreased, for example, to 1.4° C., at which time, the rate of change dTo remains unchanged, −0.7° C., the fuzzy inference shown in FIG. 23 is carried out on the basis of the control rules and the membership functions. The operation amount of the fuel control valve 17 is determined from the center of gravity $G_5$ of the membership value L with respect to the operation amount of the fuel control valve 17.

Figure 24:
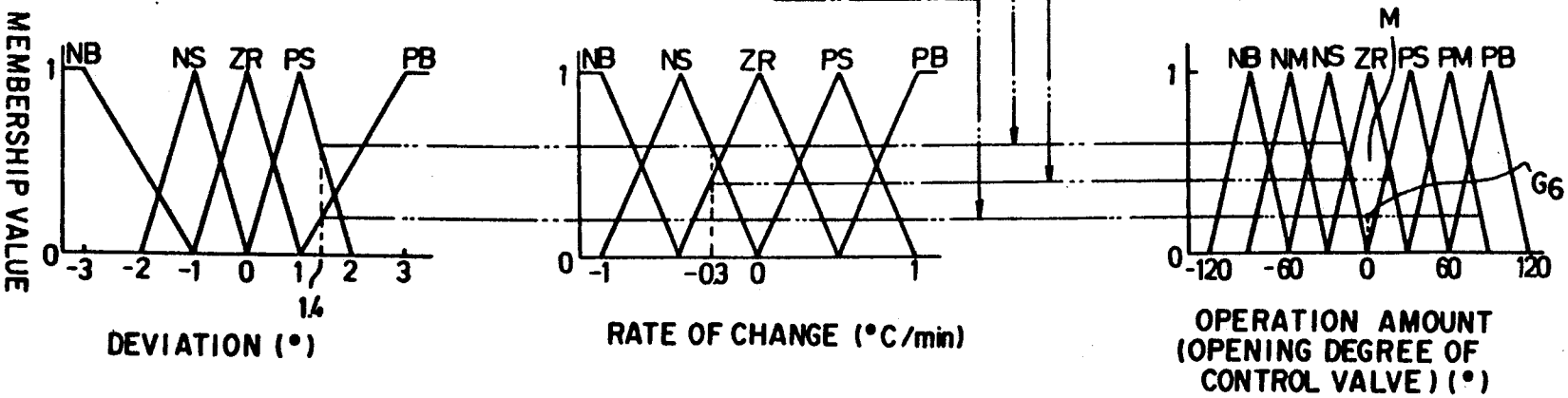
FIG. 24 illustrates a fuzzy inference when the deviation is 1.4° C. and the rate of change is −0.3° C./min.

In the case where the deviation eTo is 1.4° C., for example, and the rate of change dTo is −0.3° C./min, for example, the fuzzy inference shown in FIG. 24 is carried out on the basis of the control rules and membership functions. The operation amount is determined from the center of gravity $G_6$ of the membership value M of the operation amount of the fuel control valve 17. Here, the operation amount is zero, and the operation amount (opening degree) of the fuel control valve 17 remains unchanged.

Thereafter, the fuzzy inference is carried out, when the absorption refrigerator is operated, on the basis of the deviation eTo from the set value of the cold-water outlet temperature, the rate of change dTo of the cold-water outlet temperature, the control rules shown in FIG. 21 and the membership functions shown in FIGS. 3, 4 and 13, and the operation amount of the heating amount control valve 17 is controlled.

According to the aforementioned embodiment, the matrix-like control rules are constituted between the deviation from the set value of the cold-water outlet temperature and the rate of change of the cold-water outlet temperature as shown in FIG. 21. Therefore, as compared with the case where the operation amount of the fuel control valve 17 is determined singly with respect to the deviation or the rate of change, the excessive amount in the neighbourhood of the set value of the cold-water outlet temperature can be slightly suppressed, and the stability of the cold-water outlet temperature with respect to the variation of load can be improved.

In the case where the cold-water outlet temperature is greatly deviated from the set value, the operation amount with respect to the rate of change is set large and in the neighbourhood of the set value, the operation amount with respect to the rate of change is set small, whereby the convergence degree in the neighbourhood of the set value of the cold-water outlet temperature can be enhanced, and the stability with respect to the variation of the load can be further improved.

While in the aforementioned embodiment, the description has been made of the absorption refrigerator in which cold water is supplied from the evaporator 4 to the load, it is to be noted that the similar function and effect can be obtained from an aborption refrigerator in which a hot water unit is provided on a high temperature generator 1 so that hot water is supplied from the hot water unit, and the heating amount of the high temperature generator is controlled on the basis of the hot water outlet temperature when the hot water is mainly controlled and the amount of the refrigerant which flows from the high temperature generator to the condenser is adjusted by a control value on the basis of the cold-water outlet temperature, wherein matrix-like control rules are constituted between a deviation from a set value of the cold-water outlet temperature and a rate of change of the cold-water outlet temperature, and membership functions are constituted between the deviation, the rate of change and the operation amount of the control valve, whereby the opening degree of the control valve, i.e., the quantity of the refrigerant which flows from the high temperature generator 1 to the condenser is controlled by the fuzzy logic calculation on the basis of the control rules and the membership functions.

The matrix-like control rules between the deviation and the rate of change are not limited to those shown in FIG. 1 but may be constituted according to the ability of the absorption refrigerator or the like.

Figure 25:
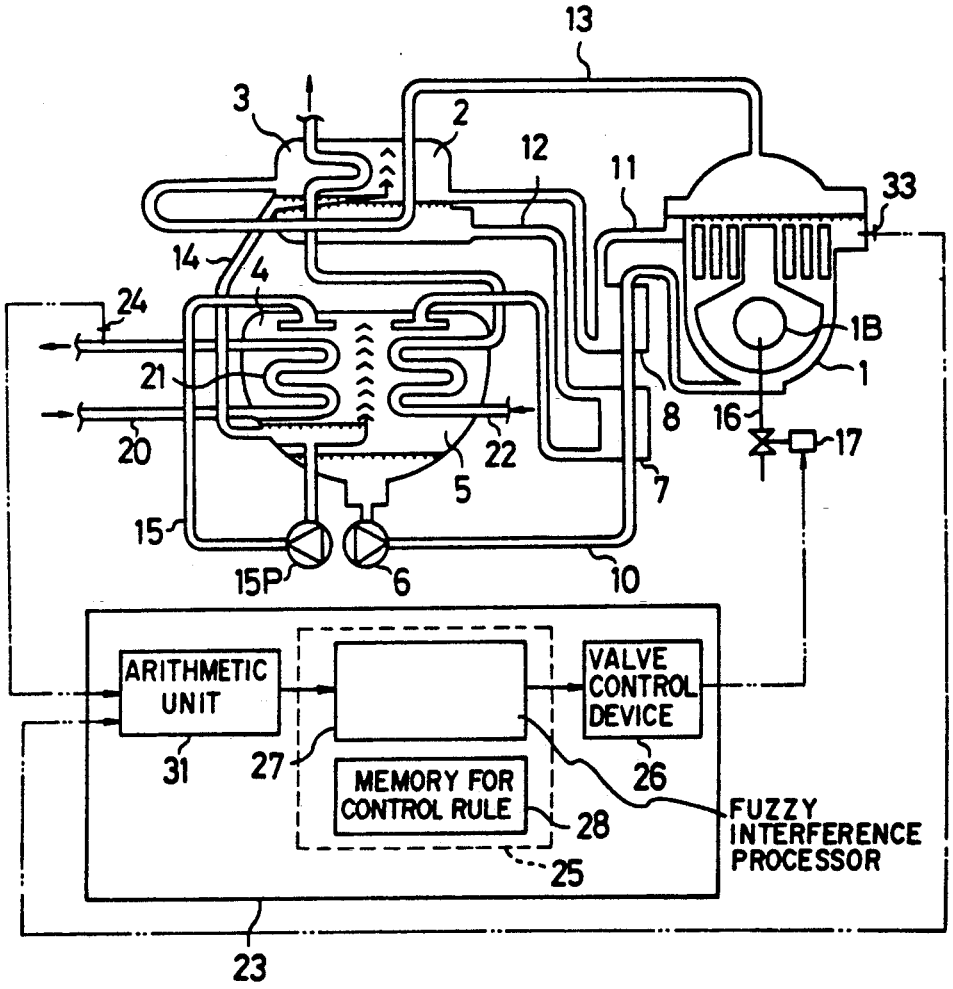
FIG. 25 is a circuit representation of an absorption refrigerator in Embodiment 8.

Next, an eighth embodiment will be described with reference to FIG. 25 and others. Reference numeral 33 designates a high temperature generator and a temperature detector (hereinafter referred to as HG temperature detector) mounted on a high temperature generator 1. The rate of change of temperature is obtained by an arithmetic unit 30 on the basis of the measured temperature data. The fuzzy inference processor 27 logic-calculates the operation amount to the fuel control valve 17 using a deviation from a set value of a cold-water outlet temperature, a rate of change of the cold-water outlet temperature and a rate of change of a high temperature generator temperature, and the obtained operation amount is output to the control device 26. The control device 26 controls the opening degree of the fuel control valve 17 on the basis of the aforesaid operation amount. In this embodiment, the opening degree of the fuel control valve 17 is output from the fuzzy inference processor 27. The memory 28 for the control rule stores fuzzy rules (control rules) and membership functions required for the logic calculation executed by the fuzzy inference processor 27. The arithmetic unit 31 inputs temperature data from the cold-water outlet temperature detector 24 and HG temperature detector 30, calculates the deviation from the set value of the cold-water outlet temperature, the rate of change by one minute, for example of the cold-water outlet temperature and the rate of change by one minute, for example, of the high temperature generator temperature, and outputs the calculated result to the fuzzy inference processor 27.

The fuzzy rules stored in the memory 28 are the matrix-like fuzzy rules shown in FIG. 26 wherein eTo is the deviation from the set value of the cold-water outlet temperature and dTo is the rate of change of the cold-water outlet temperature.

Among fuzzy rules shown in FIG. 26, fuzzy rules marked by *, that is, fuzzy rules when the deviation is PS, ZR and NS are matrix-like fuzzy rules shown in FIGS. 27, 28 and 29 wherein dTo is the rate of change of temperature of the high temperature generator 1. FIG. 27 shows the matrix-like fuzzy rules between the rate of change dTo of the cold-water outlet temperature and the rate of change dTo of the high temperature generator temperature when the deviation eTo is PS. FIG. 28 shows the matrix-like fuzzy rules between the rates of change when the deviation eTo is ZR. FIG. 29 shows the matrix-like fuzzy rules between the rates of change when the deviation eTo is NS. The fuzzy rules are constituted on the basis of the human experimences and stored in the memory 28. In FIGS. 27, 28 and 29, PZ stands for Positive Zero, and NZ stands for Negative Zero.

Figure 30:
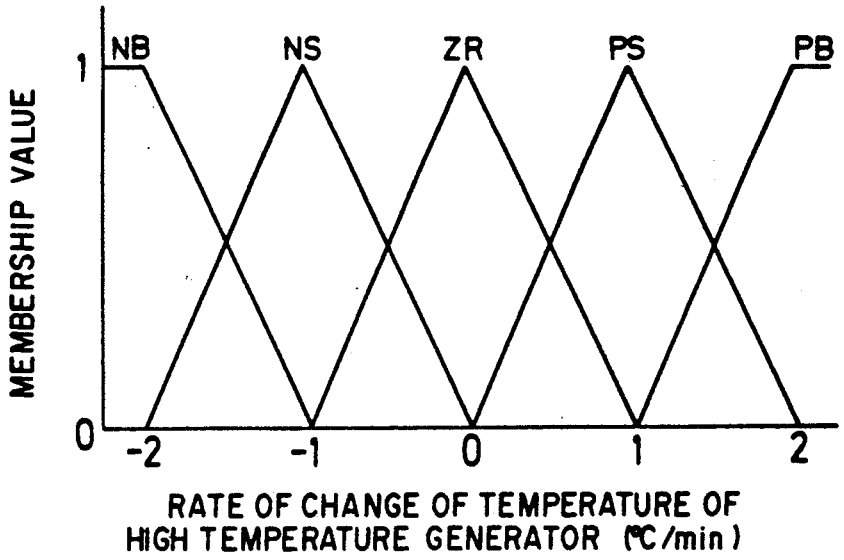
FIGS. 30 and 31 illustrate the membership function.
Figure 31:
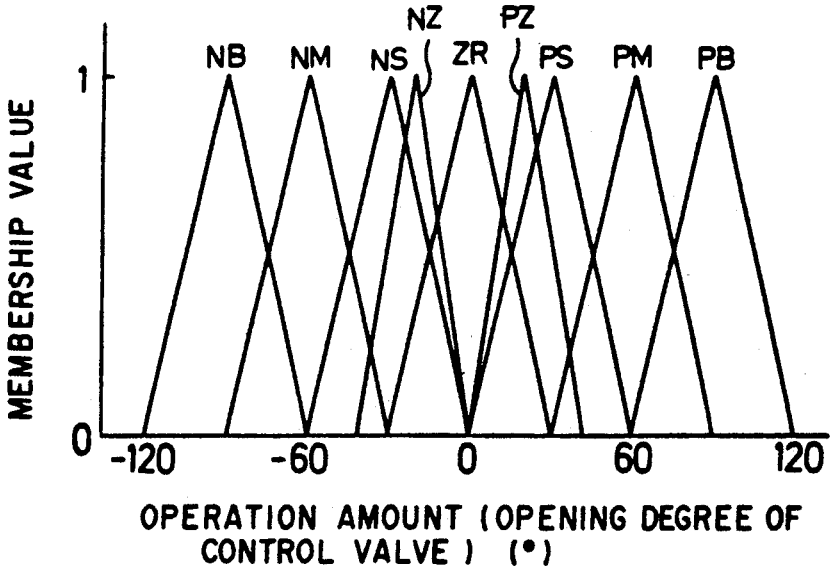

The membership functions for qualitatively evaluating the deviation from the set value of the cold-water outlet temperature are determined as shown in FIG. 3 previously mentioned, the membership functions for qualitatively evaluating the rate of change of the cold-water outlet temperature determined as shown in FIG. 13 previously mentioned, the membership functions for qualitatively evaluating the change of temperature of the high temperature generator 1 determined as shown in FIG. 30, and the membership functions for evaluating the qualitatively evaluated membership values to the quantative operation amount of the fuel control valve 17 determined as shown in FIG. 31, the membership functions being stored in the memory 28 similar to the fuzzy rules.

In the case where the deviation eTo is small, the rate of change of the temperature of the high temperature generator is used to control the operation amount of the fuel control valve 17, and the operation amount is adjusted little by little on the basis of the fuzzy rules shown in FIGS. 27, 28 and 29.

When the absorption refrigerator structured as described above is operated, the burner 1B of the high temperature generator 1 burns, and the absorption liquid pump 6 and the refrigerant pump 15P are operated. The refrigerant steam separated from the absorption liquid in the high temperature generator 1 by the combustion of the burner 1B flows into the refrigerant pipe 13 similar to the conventional absoption refrigerator, and the refrigerant liquid condensed at the low temperature generator 2 flows into the condenser 3. The refrigerant steam separated from the intermediate absorption liquid in the low temperature generator 2 is condensed at the condenser 3, and the refrigerant liquid stayed in the condenser 3 flows down to the evaporator 4. The refrigerant flowed into the evaporator 4 is scattered to the evaporator heat exchanger 21 by the operation of the refrigerant pump 15P, and cold water lowered in temperature by the evaporator heat exchanger 21 is supplied to the load. The refrigerant steam vaporized by the evaporator 4 is absorbed into the concentrated absorption liquid of the absorption unit 5, and the rare absorption liquid is sent to the high temperature generator 1 by the operation of the absorption liquid pump 6.

Figure 32:
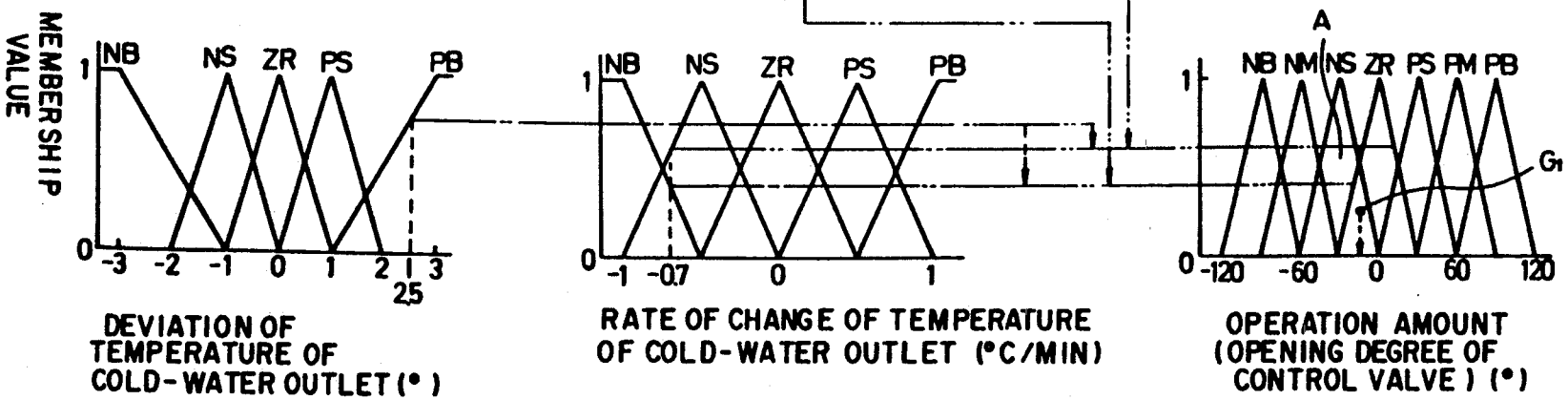
FIG. 32 illustrates a fuzzy inference when the deviation is large.
Figure 33:
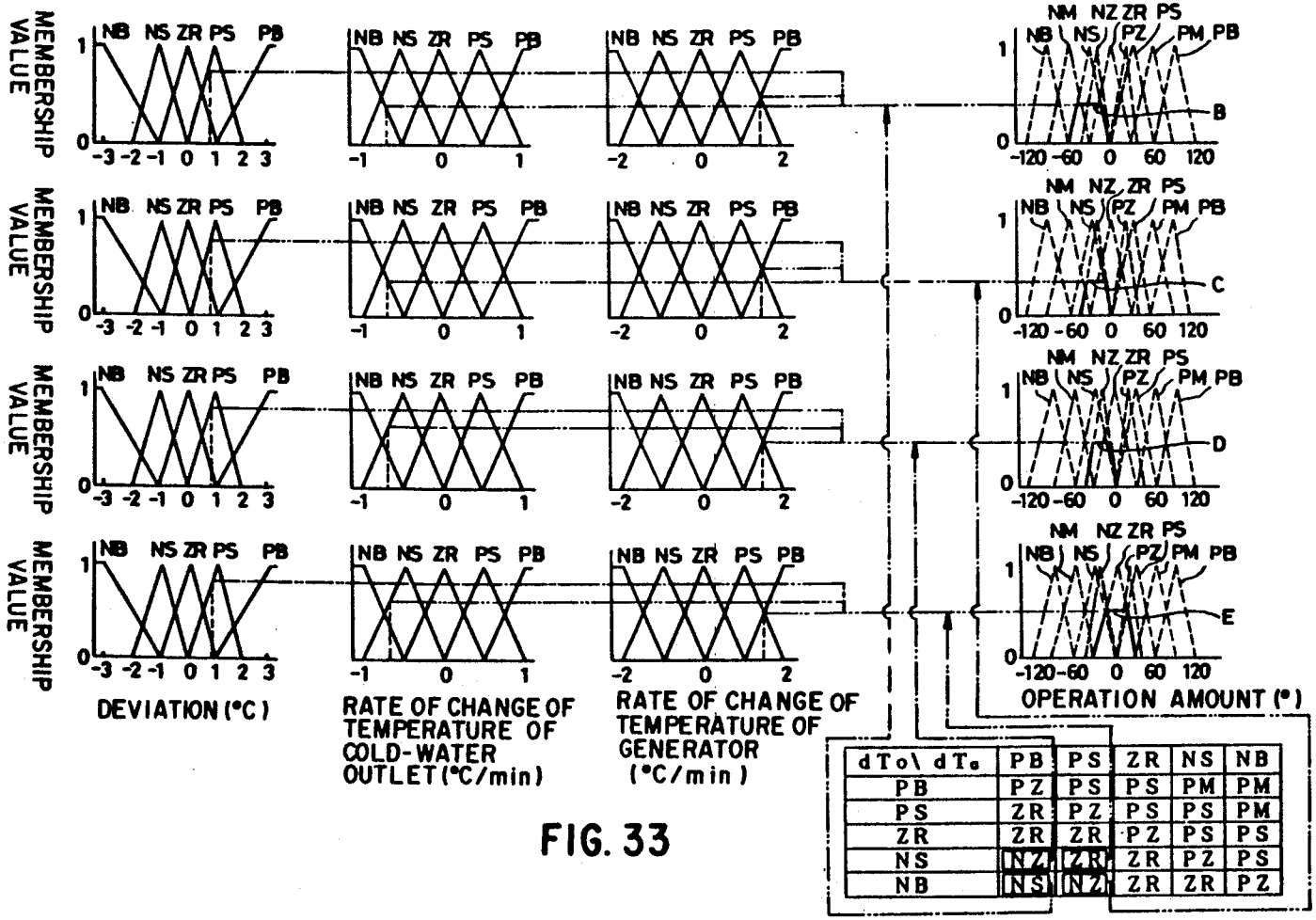
FIGS. 33, 34 and 35 illustrate a fuzzy inference when the deviation is small.
Figure 34:
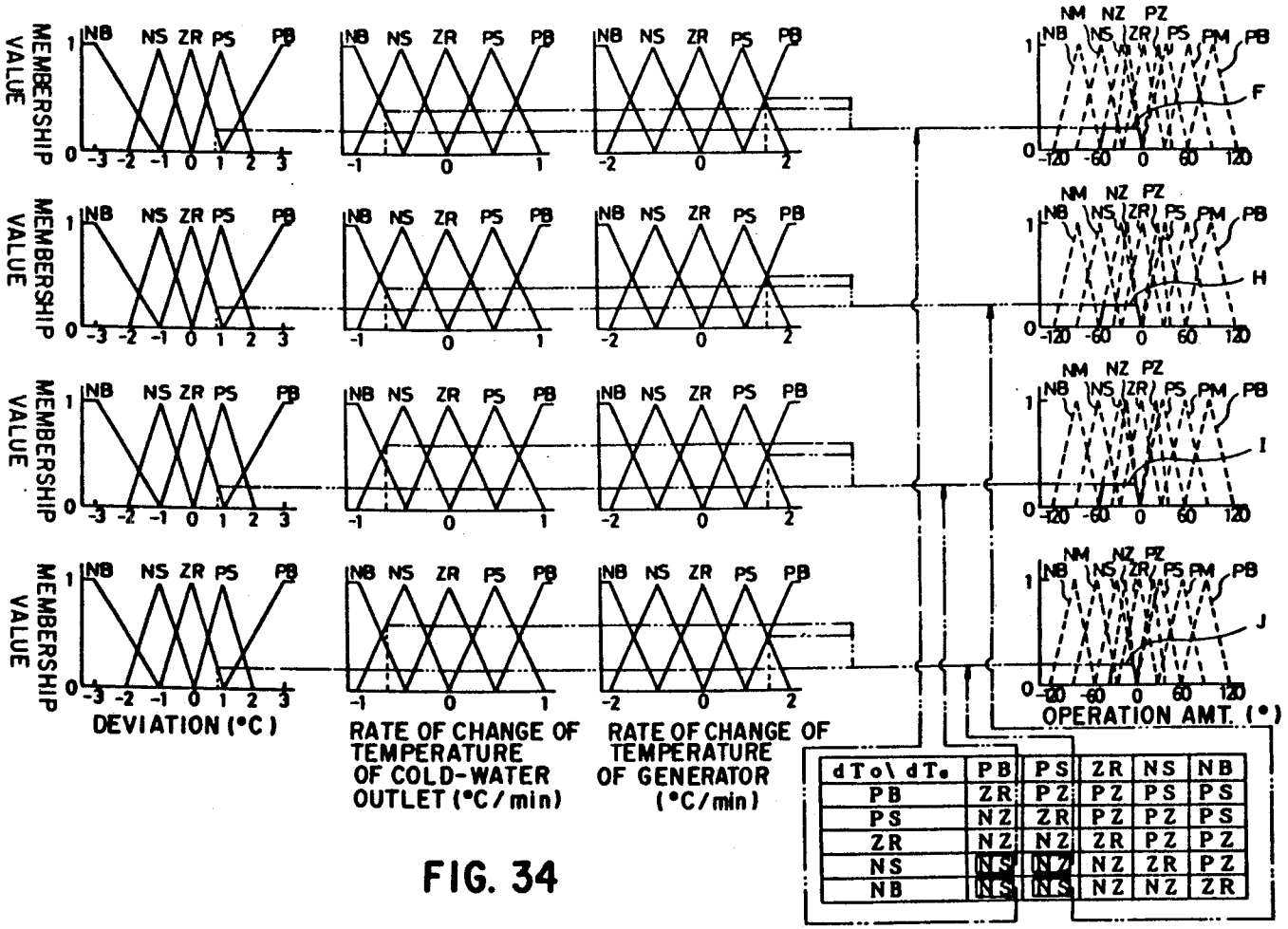
Figure 35:
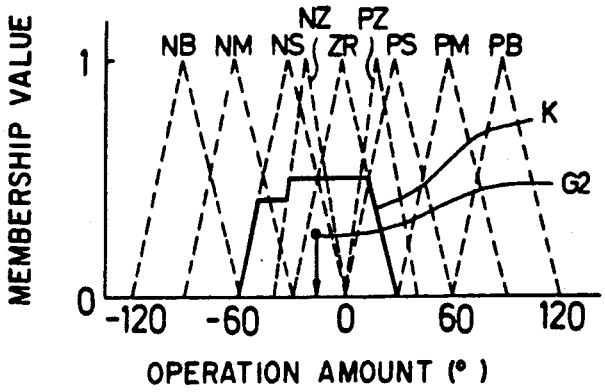
Figure 36:
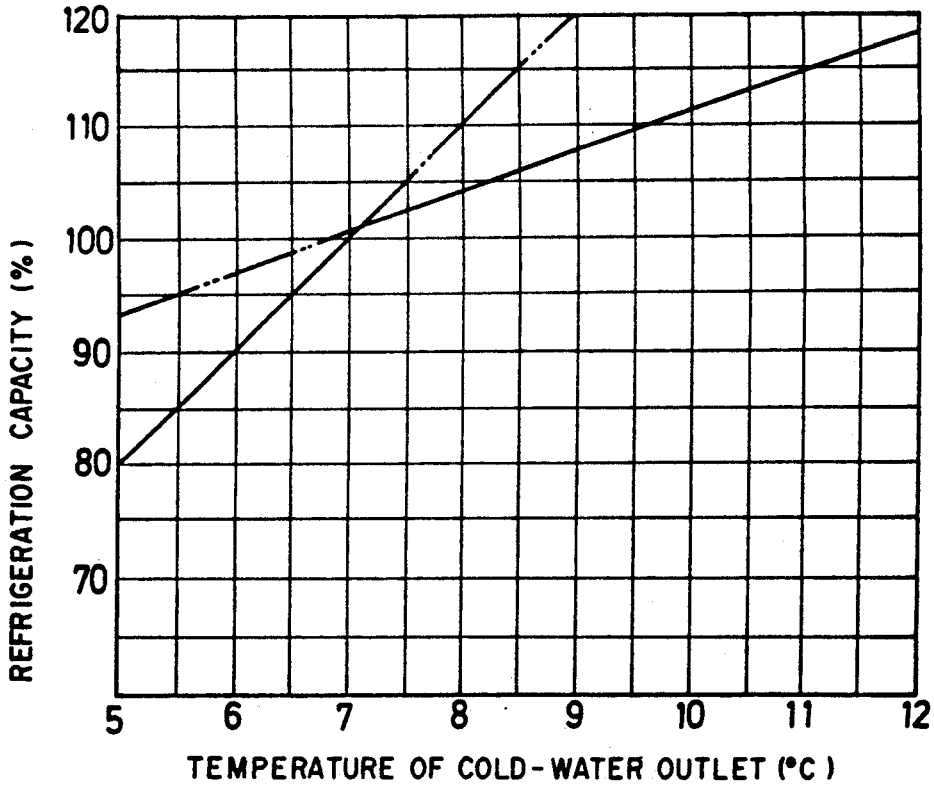
FIG. 36 shows the relationship between a cold-water outlet temperature and a refrigeratin capacity (refrigeration ability) in a conventional system.

When the absorption refrigerator is being operated as described above, the cold-water outlet temperature detector 24 and HG temperature detector 30 detect temperatures and output temperature data to the arithmetic unit 31. The arithmetic unit 31 calculates, on the basis of the aforesaid temperature data, the deviation from the set value of the cold-water outlet temperature, the rate of change by one minute, for example, of the cold-water outlet temperature, and the rate of change by one minute, for example, of the temperature of the high temperature generator 1. In the case where the deviation from the set value of the cold-water outlet temperature, that is, the deviation is 2.5° C., for example, and at that time, the rate of change of the cold-water outlet temperature is −0.7° C./min, the fuzzy inference shown in FIG. 32 is carried out on the basis of the membership functions and the fuzzy rules. The operation amount of the fuel control valve 17 is determined from the center of gravity $G_1$ of the membership value A shown in FIG. 32. In the case where the deviation is 0.8° C., for example, and at that time, the rate of change of the cold-water outlet temperature is −0.7° C./min, for example, and the rate of change of temperature of the high temperature generator 1 is 1.5° C./min, for example, the relationship between the deviation eTo and the rate of change dTo of the cold-water outlet temperature is positioned at the fuzzy rules marked by * in FIG. 26. The fuzzy inference when the deviation eTo is PS is carried out as shown in FIG. 33 on the basis of the membership functions shown in FIGS. 3 and 31 and the fuzzy rules shown in FIG. 27. The membership values B, C, D and E with respect to the operation amount are obtained. Further, the fuzzy inference when the deviation eTo is ZR is carried out as shown in FIG. 34 on the basis of the membership functions shown in FIGS. 3 and 31 and the fuzzy rules shown in FIG. 28. Then, the membership values F, H, I and J with respect to the operation amount are obtained. A determination is made by the fuzzy inference so that when the rate of change of the temperature of the high temperature generator 1 is positive, the refrigeration ability tends to increase whereas when the rate of change is negative, the refrigeration ability tends to decrease. The membership value composed of these membership values B, C, D, E, F, H, I and J superposed to one another is indicated at K in FIG. 35. The operation amount of the fuel control valve 17 is determined from the center of gravity $G_2$ of the membership value K.

In the case where the relationship between the deviation eTo and the rate of change dTo of the cold-water outlet temperature is positioned at * in FIG. 26, similarly to the control of the operation amount of the fuel control valve 17, the fuzzy inference is carried out on the basis of the membership functions shown in FIGS. 3 and 31 and the fuzzy rules shown in FIGS. 27, 28 and 29. When the deviation between the cold-water outlet temperature and the set value is zero or small, the fuzzy rules using the rate of change of the temperature of the high temperature generator 1 are used to control the operation amount (opening degree) of the fuel control valve 17. The rate of change of the temperature of the high temperature generator 1 is used to control the operation amount of the fuel control valve 17 in advance. For example, even if both the deviation eTo and the rate of change dTo are zero, the operation amount of the fuel control valve 17 is controlled according to the rate of change dTo.

According to the aforementioned embodiment, when the deviation eTo is small or zero, the fuzzy inference based on the human experiences is carried out using the fuzzy rules between the rate of change dTo of the temperature of the high temperature generator 1 shown in FIGS. 27 to 29 and the membership functions shown in FIG. 30 so that a determination is made whether the refrigeration ability tends to increase or decrease, whereby the operation amount of the heating amount control valve 17 is controlled. Therefore, the operation amount of the fuel control valve 17 is controlled by the fuzzy inference before the change in the cold-water outlet temperature caused by the variation of the load appears, and the cold-water outlet temperature can be stabilized to the set value in a short period of time, as a consequence of which the operation of the absorption refrigerator can be stabilized. In addition, it is possible to avoid wasteful time when the operation amount of the fuel control valve 17 is controlled with respect to the variation of the load and the delay of the control of the fuel control valve 17 resulting from the delay to prevent a wasteful consumption of fuel.

The present invention is not limited to the above-described embodiments but the fuzzy rules and the membership functions differ with the ability of the absorption refrigerator and the like.

While in the above-described embodiment, the description has been made of the control device for the absorption refrigerator provided with the high temperature generator 1 having the burner 1B, it is to be noted that the similar function and effect can be obtained even by a control device for an absorption refrigerator in which a high temperature and high pressure steam is used as a heat source of the high temperature generator 1, and the amount of high temperature and high pressure steam supplied to the high temperature generator 1 is adjusted by a control valve, wherein the fuzzy inference is carried out similarly to the above-described embodiment to control the operation amount of the control valve.

Furthermore, the matrix-like fuzzy rules are constituted between the rate of change of the cold-water outlet temperature when the deviation from the set value of the cold-water outlet temperature and the rate of change of the temperature of the high temperature generator 1, and even when the deviation of the cold-water outlet temperature is large, the rate of change of the temperature of the high temperature generator 1 is used to effect the fuzzy inference whereby the operation amount of the fuel control valve 17 can be controlled to early stabilize the cold-water outlet temperature to the set value.

The present invention provides a control device for an absorption refrigerator constructed as described above, in which singular or plural amounts of change representative of the external conditions are detected, and the heating amount of the generator is controlled by the fuzzy logic calculation. Therefore, the heating amount based on the human experiences with respect to the control of the heating amount according to the external conditions such as the deviation from the set value of the cold-water outlet temperature can be adjusted, and the control of the heating amount of the high temperature generator according to the change of the cold-water outlet temperature can be attained.

Furthermore, information representative of the magnitude of the load is detected by a detector, and the heating amount of the generator is calculated by a calculation device using the fuzzy logic calculation on the basis of the control rules stored in the memory and the aforesaid information. Therefore, the control of the heating amount of the high temperature generator based on the human experiences can be carried out, and the heating amount according to the variation of load can be adjusted to stabilize temperatures of cold water or hot water supplied to the load.

Particularly, the membership functions and fuzzy rules are determined, and the fuzzy inference is carried out on the basis of the fuzzy rules and the membership functions. In the case where the cold-water outlet temperature is higher than the preset value, the heating amount of the generator is slowly changed, and in the case where the temperature is lower than the set value, the heating amount of the generator is rapidly changed. Therefore, in the case where the cold-water outlet temperature is lower than the set value or in the case where the temperature is higher than the set value, the excessive lowering of the cold-water outlet temperature can be prevented, and the cold-water outlet temperature can be stabilized.

Moreover, the membership functions or fuzzy rules between the cold-water outlet temperature and the operation amount of the heating amount control valve of the generator are constituted so that in the case where the cold-water outlet temperature is lower than the set value, the operation amount is rapidly changed, and in the case where the temperature is higher than the set value, the operation amount is slowly changed. The fuzzy inference is then carried out to control the heating amount control valve. Therefore, in the case where the cold-water outlet temperature is higher or lower than the set value, the opening degree of the heating amount control valve can be optimally controlled to prevent the excessive lowering of the cold-water outlet temperature to stabilize the cold-water outlet temperature.

Furthermore, the membership functions and fuzzy rules determined so that in the case where the cold-water outlet temperature is higher than the set value, the heating amount of the generator is slowly changed and in the case where the temperature is lower than the set value, the heating amount is rapidly changed are stored in the memory whereby the fuzzy inference is carried out on the basis of the membership functions and fuzzy rules to obtain the operation amount of the heating amount control valve by the calculation device. Therefore, the operation amount can be adjusted so as to meet the characteristic of the absorption refrigerator, as a consequence of which the cold-water outlet temperature can be stabilized.

Moreover, the heating amount of the generator is controlled by the fuzzy logic calculation on the basis of the deviation from the set value of the cold-water outlet temperature, the rate of change of the cold-water outlet temperature, the rate of change of the cold-water inlet temperature or the rate of change of the cold-water inlet temperature, the membership functions and the fuzzy rule. Therefore, in the case where the cold-water outlet temperature, the cold-water inlet temperature or the cold-water inlet temperature is changed due to the change of the load or the change of the cooling-water temperature, the control of the heating amount of the generatore based on the human experiences can be carried out, the heating amount of the generator according to the change of the load or the cooling-water temperature is adjusted, and the temperature of the cold water or hot water can be stabilized.

Furthermore, the membership functions are constituted between the deviation from the set value of the cold-water outlet temperature, the rate of change of the cold-water outlet temperature and the operation amount of the heating amount control valve, and the matrix-like fuzzy rules are constituted between the deviation and the rate of change, whereby the fuzzy logic calculation is carried out to control the operation amount of the heating amount control valve. Therefore, in the case where the cold-water outlet temperature is deviated from the set value due to the variation of the load, the aforesaid operation amount can be adjusted on the basis of the control rules between the deviation and the rate of change to enhance the stability of the outlet temperature with respect to the variation of the load.

Furthermore, the membership functions between the deviation, the rate of change and the operation amount of the heating amount control valve, and the matrix-like fuzzy rules between the deviation and the rate of change are stored in the memory, and the operation amount of the heating amount control valve of the generator is calculated by the calculation device by way of the fuzzy logic calculation on the basis of the cold-water outlet temperature, the membership functions and fuzzy rules of the memory. Therefore, in the case where the cold-water outlet temperature is deviated from the set value, the operation amount of the heating amount control valve is adjusted by the matrix-like fuzzy rules between the deviation and the rate of change to considerably reduce the excessive amount from the set value of the cold-water outlet temperature, and the cold-water outlet temperature can be quickly stabilized to the set value.

Moreover, the matrix-like fuzzy rules are designed so that when the deviation is large, the change of the operation amount of the heating amount control valve with respect to the rate of change is large whereas when the deviation is small, the change of the operation amount of the heating amount control valve with respect to the rate of change is small, whereby the convergence degree in the neighbourhood of the set value of the cold-water outlet temperature is enhanced, and the stability of the cold-water outlet temperature with respect to the variation of load can be further improved.

In addition, the membership functions are constituted between the rate of change of the cold-water outlet temperature, the rate of change of the temperature of the generator and the operation amount of the heating amount control valve, and the matrix-like fuzzy rules are constituted between the rates of change whereby the fuzzy inference is carried out on the basis of the aforesaid rates of change, the membership functions and the fuzzy rules to control the operation amount of the heating amount control valve. Therefore, the rate of change of the temperature of the high temperature generator is used for controlling the operation amount of the fuel control valve, and the cold-water outlet temperature can be quickly made close to the set value. It is further possible to avoid the wasteful time and a wasteful consumption of fuel resulting from the delay to save energy.

Furthermore, the membership functions, the matrix-like like fuzzy rules between the deviation of the cold-water outlet temperature and the rate of change of the cold-water outlet temperature, and the matrix-like fuzzy rules between the rate of change of the cold-water outlet temperature and the rate of change of the temperature of the generator are stored in the memory, and the fuzzy logic calculation is carried out by the calculation device on the basis of the aforesaid deviation, the rates of change, the membership functions and the fuzzy rules to calculate the operation amount of the heating amount control valve. Therefore, the rate of change of the temperature of the high temperature generator is used for controlling the operation amount, and the cold-water outlet temperature can be stabilized to the set value in a short period of time. In addition, it is possible to prevent a wasteful consumption of fuel in the generator.

Moreover, when the deviation from the set value of the cold-water outlet temperature is zero or small, the matrix-like fuzzy rules are constituted between the rate of change of the cold-water outlet temperature and the rate of change of the temperature of the generator, and the fuzzy inference is carried out on the basis of the aforesaid fuzzy rules to control the operation amount of the heating amount control valve. Therefore, when the cold-water outlet temperature is close to the set value, the cold-water outlet temperature can be positively stabilized to the set value, and the wasteful time and the wasteful consumption of fuel resulting from delay can be prevented.

What is claimed is:

1. A control device for an absorption refrigerator which forms a refrigeration cycle comprising:

an evaporator, an absorption unit, a generator, a condenser and the like connected to control a heating amount of the generator, wherein membership functions and fuzzy rules are defined between a deviation from a set value of a cold-water outlet temperature from the evaporator and said heating amount of said generator, and the heating amount of said generator is controlled by fuzzy logic calculation on the basis of said membership functions and fuzzy rules.

2. A control device for an absorption refrigerator which forms a refrigeration cycle comprising: an evaporator, an absorption unit, a generator, a condenser and the like connected to control a heating amount of the generator by the external conditions, wherein a deviation from a set value of a cold-water outlet temperature from the evaporator is used as said external condition, membership functions and fuzzy rules are determined between said deviation and the heating amount of the generator, and the fuzzy inference is carried out on the basis of said fuzzy rules and said membership functions, wherein in the case where the cold-water outlet temperature is higher than the set value, said heating amount is slowly changed whereas in the case where the cold-water outlet temperature is lower than the set value, said heating amount is rapidly changed.

3. A control device for an absorption refrigerator which forms a refrigeration cycle comprising: an evaporator, an absorption unit, a generator, a condenser and the like connected to control a heating amount control valve of the generator by the external conditions, wherein a deviation from a set value of a cold-water outlet temperature from the evaporator is used as said external condition, membership functions are determined between said deviation and the operation amount of the heating amount control valve of the generator, said membership functions being designed so that in the case where the cold-water outlet temperature is higher than the set value, said operation amount is slowly changed whereas in the case where the cold-water outlet temperature is lower than the set value, said operation amount is rapidly changed, and the fuzzy inference is carried out on the basis of said membership functions to control the heating amount control valve of the generator.

4. A control device for an absorption refrigerator which forms a refrigeration cycle comprising: an evaporator, an absorption unit, a generator, a condenser and the like connected to control a heating amount control valve of the generator by the external conditions, wherein a deviation from a set value of a cold-water outlet temperature from the evaporator is used as said external condition, fuzzy rules are determined between said deviation and the operation amount of the heating amount control valve, said fuzzy rules being designed so that in the case where the cold-water outlet temperature is higher than the set value, said heating amount is slowly changed whereas in the case where the cold water outlet temperature is lower than the set value, said heating amount is rapidly changed, and the fuzzy inference is carried out on the basis of said fuzzy rules to control the heating amount control valve.

5. A control device for an absorption refrigerator which forms a refrigeration cycle comprising: an evaporator, an absorption unit, a generator, a condenser and the like connected to control a heating amount control valve of the generator by the external conditions, wherein a deviation from a set value of a cold-water outlet temperature from the evaporator is used as said external condition, said control device comprises a memory for storing membership functions and fuzzy rules which are designed so that in the case where the cold-water outlet temperature is higher than the set value, the heating amount of the generator with respect to said deviation is slowly changed whereas in the case where said temperature is lower than the set value, the heating amount of the generator is rapidly changed, and an arithmetic unit for calculating the operation amount of the heating amount control valve by carrying out the fuzzy inference on the basis of the cold-water outlet temperature, the membership functions and fuzzy rules of said memory.

6. A control device for an absorption refrigerator which forms a refrigerating cycle comprising:

an evaporator, an absorption unit, a generator, a condenser and the like connected to control a heating amount of the generator, wherein membership functions and fuzzy rules are defined between a deviation from a set value of a cold-water outlet temperature from the evaporator and said heating amount of said generator and defined between a rate of change of the cold-water outlet temperature and the heating amount of said generator, and the heating amount of said generator is controlled by fuzzy logic calculation on the basis of said membership functions and fuzzy rules.

7. A control device for an absorption refrigerator which forms a refrigeration cycle comprising: an evaporator, an absorption unit, a generator, a condenser and the like connected to control a heating amount of the generator by the external conditions, wherein a deviation from a set value of a cold-water outlet temperature from the evaporator, a rate of change of the cold-water outlet temperature and a rate of change of a cold-water inlet temperature to the evaporator are used as said external conditions, and the heating amount of said generator is controlled by the fuzzy logic calculation on the basis of said deviation, said rates of change, membership functions and fuzzy rules.

8. A control device for an absorption refrigerator which forms a refrigeration cycle comprising: an evaporator, an absorption unit, a generator, a condenser and the like connected to control a heating amount of the generator by the external conditions, wherein a deviation from a set value of a cold-water outlet temperature from the evaporator, a rate of change of the cold-water outlet temperature, a rate of change of a cold-water inlet temperature to the evaporator and a rate of change of a cooling-water inlet temperature to the absorption unit are used as said external conditions, and the heating amount of said generator is controlled by the fuzzy logic calculation on the basis of said deviation, said rates of change, membership functions and fuzzy rules.

9. A control device for an absorption refrigerator which forms a refrigeration cycle comprising: an evaporator, an absorption unit, a generator, a condenser and the like connected to control a heating amount control valve of the generator by the external conditions, wherein a deviation from a set value of a cold-water outlet temperature and a rate of change of the cold-water outlet temperature are used as said external conditions, membership functions are constituted between said deviation, said rate of change and the operation amount of the heating amount control valve, and matrix-like fuzzy rules are constituted between said deviation and said rate of change, wherein the fuzzy inference is carried out on the basis of said deviation, said rate of change, said membership functions and said fuzzy rules to control the operation amount of the heating amount control valve.

10. A control device for an absorption refrigerator which forms a refrigeration cycle comprising: an evaporator, an absorption unit, a generator, a condenser and the like connected to control a heating amount control valve of the generator by the external conditions, wherein a deviation from a set value of a cold-water outlet temperature and a rate of change of the cold-water outlet temperature are used as said external conditions, said control device comprises a memory for storing said deviation, membership functions between the rate of change and the operation amount of the heating amount control valve of the generator and matrix-like fuzzy rules between said deviation and the rate of change, and an arithmetic unit for calculating the operation amount of the heating amount control valve by carrying out the fuzzy logic calculation on the basis of said deviation, the rate of change, the membership functions and fuzzy rules of said memory.

11. A control device for an absorption refrigerator which forms a refrigeration cycle comprising: an evaporator, an absorption unit, a generator, a condenser and the like connected to control a heating amount control valve of the generator by the external conditions, wherein a deviation from a set value of a cold-water outlet temperature and a rate of change of the cold-water outlet temperature are used as said external conditions, membership functions are constituted between said deviation, the rate of change and the operation amount of the heating amount control valve, matrix-like fuzzy rules are determined between said deviation and the rate of change, said fuzzy rules being designed so that when said deviation is large, the change of said operation amount with respect to the rate of change is large whereas when said deviation is small, the change of said operation amount with respect to the rate of change is small, and the fuzzy inference is carried out on the basis of said deviation, the rate of change, the membership functions and the fuzzy rules to control the operation amount of the heating amount control valve.

12. A control device for an absorption refrigerator which forms a refrigeration cycle comprising: an evaporator, an absorption unit, a generator, a condenser and the like connected to control a heating amount control valve of the generator by the external conditions and internal conditions, wherein a rate of change of the cold-water outlet temperature is used as said external condition, a rate of change of a temperature of the generator is used as said internal condition, member ship functions are constituted between said rates of change and the operation amount of the heating amount control valve, matrix-like fuzzy rules are constituted between said rates of change, and the fuzzy inference is carried out on the basis of said rates of change, said membership functions and said fuzzy rules to control the operation amount of the heating amount control valve.

13. A control device for an absorption refrigerator which forms a refrigeration cycle comprising: an evaporator, an absorption unit, a generator, a condenser and the like connected to control a heating amount control valve of the generator by the external conditions and internal conditions, wherein a deviation from a set value of a cold-water outlet temperature and a rate of change of a cold-water outlet temperature are used as said external conditions, a rate of change of a temperature of the generator is used as said internal condition, and said control device comprises a memory for storing said deviation, the rates of change, membership functions of the operation amount of the heating amount control valve, matrix-like fuzzy rules between said deviation and the rate of change of the cold-water outlet temperature and matrix-like fuzzy rules between the rate of change of the cold-water outlet temperature and the rate of change of the temperature of the generator, and an arithmetic unit for calculating the operation amount of the heating amount control valve by carrying out the fuzzy logic calculation on the basis of said deviation, the rates of change, the membership functions and the fuzzy rules.

14. A control device for an absorption refrigerator which forms a refrigeration cycle comprising an evaporator, an absorption unit, a generator, a condenser and the like connected to control a heating amount control valve of the generator by the external conditions and internal conditions, wherein a deviation from a set value of a cold-water outlet temperature and a rate of change of the cold-water outlet temperature are used as said external conditions, a rate of change of a temperature of the generator is used as said internal condition, membership functions are constituted between said deviation, the rates of change and the operation amount of the heating amount control valve, and matrix-like fuzzy rules are constituted between said rates of change, wherein when the deviation from the set value of the cold-water outlet temperature is small, the fuzzy inference is carried out on the basis of said deviation, the rates of change, the membership functions and the fuzzy rules.

15. A control device for an absorption refrigerator which forms a refrigeration cycle comprising: an evaporator, an absorption unit, a generator, a condenser and the like connected to control a heating amount control valve of the generator by the external conditions and internal conditions, wherein a deviation from a set value of a cold-water outlet temperature and a rate of change of the cold-water outlet temperature are used as said external conditions, a rate of change of a temperature of the generator is used as said internal condition, matrix-like fuzzy rules are constituted between said deviation and the rate of change of the cold-water outlet temperature, said fuzzy rules comprising matrix-like fuzzy rules constituted between the rate of change of the cold-water outlet temperature and the rate of change of the temperature of the generator, wherein the fuzzy inference is carried out on the basis of said deviation, the rates of change and the fuzzy rules to control the operation amount of the heating amount control valve.

* * * * *

UNITED STATES PATENT AND TRADEMARK OFFICE

CERTIFICATE OF CORRECTION

PATENT NO. : 5,156,013

DATED : October 20, 1992

INVENTOR(S) : ARIMA et al

It is certified that error appears in the above-identified patent and that said Letters Patent is hereby corrected as shown below:

On the title page, in item [75]:
Please change the name of the city of residence for the last three inventors from "HIRAKATA" to --OSAKA-FU--.

Signed and Sealed this

Twelfth Day of October, 1993

*Attest:*

*Attesting Officer*

Bruce Lehman

BRUCE LEHMAN

*Commissioner of Patents and Trademarks*